United States Patent [19]

Ohtsuka

[11] Patent Number: 4,766,461

[45] Date of Patent: Aug. 23, 1988

[54] APPARATUS FOR PROJECTING, RECORDING AND COPYING AN IMAGE IN AN ELECTROPHOTOGRAPHIC SYSTEM HAVING MECHANISMS FOR SIMULTANEOUSLY PROJECTING AND RECORDING THE SAME IMAGE

[75] Inventor: Shuichi Ohtsuka, Kaisei, Japan

[73] Assignee: Fuji Photo Film Co., Ltd., Kanagawa, Japan

[21] Appl. No.: 32,809

[22] Filed: Apr. 1, 1987

[30] Foreign Application Priority Data

Apr. 1, 1986 [JP] Japan ..... 61-075161

[51] Int. Cl.[4] ..... G03G 15/00

[52] U.S. Cl. ..... 355/5; 355/8; 355/11; 355/45; 355/66

[58] Field of Search ..... 355/5, 8, 11, 44, 45, 355/66

[56] References Cited

U.S. PATENT DOCUMENTS 3,526,456 9/1970 Sage et al. ..... 355/5

3,926,518 12/1975 Berry et al. ..... 355/14 E

*Primary Examiner*—R. L. Moses

*Attorney, Agent, or Firm*—Sughrue, Mion, Zinn, Macpeak, and Seas

[57] ABSTRACT

In a projecting, recording and copying apparatus for use in an electrophotographic system, a movable mirror of a narrow width capable of traveling in the direction of its width and swiveling about its longitudinal axis is used so as to reflect a portion of the light rays shone by an image-forming optical system, thereby forming an image on the photosensitive material provided on the surface of a drum. The light rays passing by the movable mirror are focused on a screen. Since the movable mirror is moved in a swiveling manner, it is possible to project an image onto the screen and at the same time to form the same on the photosensitive material by means of a single mirror.

11 Claims, 27 Drawing Sheets

APPARATUS FOR PROJECTING, RECORDING AND COPYING AN IMAGE IN AN ELECTROPHOTOGRAPHIC SYSTEM HAVING MECHANISMS FOR SIMULTANEOUSLY PROJECTING AND RECORDING THE SAME IMAGE

BACKGROUND OF THE INVENTION

1. Field of the Invention

The present invention relates generally to a projecting, recording and copying apparatus for use in an electrophotographic system, and more particularly to a projecting, recording and copying apparatus for use in an electrophotographic system which is arranged to carry out formation of an image on a screen thereof, simultaneously with that of the same image on a photosensitive drum.

2. Description of the Related Art

Projecting and recording systems of the type that records an image on a predetermined frame of a photosensitive film such as a microfilm, and that is capable of projecting the thus-recorded image, have heretofore been proposed, for example, in U.S. Pat. Nos. 4,461,566 and 3,697,176.

Also, a reader printer for enlarging an image recorded on a film, and projecting the image on a screen or copying the image has been proposed in U.S. Pat. Nos. 3,811,769 and 3,907,418.

It has hitherto been known that two movable mirrors are employed in an apparatus of the type in which enlarged images of frames of microfilm are formed on a photosensitive drum by means of a conventional mirror scan.

In the conventional apparatus having three functions of recording a manuscript on a film as an image, projecting the image recorded and copying the same, however, it is difficult to ensure enough space for disposition of an optical system, and a long optical path length is needed to ensure enough space to enable the two movable mirrors to move, and this leads to the problem that a compact optical system cannot be realized.

SUMMARY OF THE INVENTION

In view of the above-described circumstances, it is an object of the present invention to provide a projecting, recording and copying apparatus for use in an electrophotographic system which enables projecting and copying to be effected at the same time, and yet which is provided with a compact optical system.

To this end, the present invention provides a projecting, recording and copying apparatus which, as shown in FIG. 1, comprises an image forming optical system 3 for forming an image recorded on film 1 on a screen 2; a movable mirror 4 of a narrow width disposed between the screen 2 and the image-forming optical system 3 in such a manner as to be capable of traveling in the direction of its width and swiveling about its longitudinal axis so as to reflect a portion of the light rays transmitted through the image forming optical system 3; a drum 5 disposed for free rotation about its axis and having a photosensitive material on its surface; a mirror-moving device for causing movement of the movable mirror 4 so that, if l represents the length of a perpendicular drawn to the screen 2 from a principal point H of the image-forming optical system 3, $\theta$ representing an angle formed by the perpendicular and a straight line connecting the principal point H and a center M of the movable mirror 4, $l\sec\theta$ is the sum of an optical path length x as between the principal point H and the center M of the movable mirror 4 and an optical path length y as between the center M of the movable mirror 4 and a center P of the surface of the drum 5; a mirror swiveling device for causing the movable mirror 4 to swivel about its axis in such a manner that a normal N passing the center M of the movable mirror 4 normally passes the inner center of a triangle the vertexes of which are constituted by the center M of the movable mirror 4, the center P of the surface of the drum 5 and the principal point H.

Further objects, features and advantages of the present invention will become apparent from the following description of a preferred embodiment of the present invention with reference to the accompanying drawings.

BRIEF DESCRIPTION OF THE DRAWINGS

FIGS. 1 through 25 diagrammatically show one preferred embodiment of a projecting, recording and copying apparatus in accordance with the present invention, in which:

FIG. 1 is a diagram used with an aid to explaining the principle of the present invention;

FIG. 2 is a perspective view showing the external appearance of the projecting, recording and copying apparatus including a combination of a projecting and recording apparatus body and a copying machine;

FIG. 3 is a front elevational view of the external appearance of the projecting, recording and copying apparatus, the copying machine being shown by the imaginary line;

FIG. 4 is a perspective view of the external appearance of the cassette shown which is loaded into the apparatus in accordance with the presently preferred embodiment of the present invention;

FIG. 5 is a perspective view of the external appearance of the cassette shown in FIG. 4 as viewed from the reverse side thereof;

FIG. 6 is a perspective view of a tape and reels, which are accommodated by the cassette;

FIG. 7 is a detailed view of a portion of an electrophotographic film;

FIG. 8 is a sectional view of the electrophotographic film taken along the line VII—VII of FIG. 7;

FIG. 9 is a schematic perspective view of a recording optical system in the projecting, recording and copying apparatus;

FIG. 10 is a schematic perspective view of a projecting optical system in the projecting, recording and copying apparatus;

FIG. 11 is a schematic perspective view of a copying optical system in the projecting, recording and copying apparatus;

FIG. 13 is a sectional view taken along the line XI—XI of FIG. 3 showing the internal structure of the projecting and recording apparatus body;

FIG. 14 is a plan view of the projecting and recording apparatus with a document pressing plate of a document table being removed, which corresponds to a sectional view taken along the line XII—XII of FIG. 5;

FIG. 15 is a sectional view taken along the line XIII—XIII of FIG. 13, showing the internal structure of the projecting and recording apparatus body;

FIG. 16 is a sectional view taken along the line XIV—XIV of FIG. 3, showing the internal structure of the projecting and recording apparatus body;

FIG. 17 is a sectional view taken along the line XV—XV of each of FIGS. 16 and 23, showing the internal structure of the projecting and recording apparatus body;

FIG. 18 is a sectional view taken along the line XVI—XVI of FIG. 17, showing the internal structure of the projecting and recording apparatus body;

FIG. 19 is a perspective view of a processing head for carrying out each of the steps of processing an electrophotographic film;

FIG. 20 is a sectional view of the processing head of FIG. 19, but taken along its horizontal line;

FIGS. 21 and 21A are respectively perspective views showing a pressing head in detail;

FIG. 22 is a sectional view taken along the line XX—XX of FIG. 16, showing the internal structure of the projecting and recording apparatus body;

FIG. 23 is a sectional view taken along the line XXI—XXI of FIG. 17, showing the internal structure of the projecting and recording apparatus body;

FIG. 24 is a sectional view taken along the line XXII—XXII of FIG. 17, showing the internal structure of the projecting and recording apparatus body;

FIG. 25 is a sectional view taken along the line XXIII—XXIII of FIG. 3, diagrammatically showing the internal structure of the copying machine incorporated in the projecting and recording apparatus body.

DESCRIPTION OF THE PREFERRED EMBODIMENT

Figure 1:
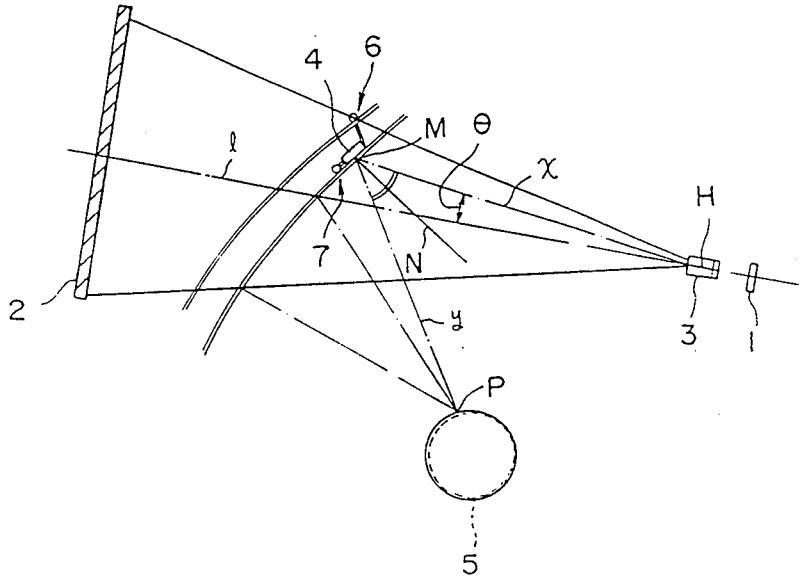

FIGS. 1 to 25 respectively show a preferred embodiment of the projecting, recording and copying apparatus to which the present invention is applied.

The operation of the present invention will first be described below in brief with specific reference to FIG. 1.

The image recorded on the film 1 is formed on the screen by an illuminating projection device disposed behind the film 1 and the image-forming optical system 3 disposed in front of the film 1. Since the movable mirror 4 is disposed between the image forming optical system 3 and the screen 2, a portion of the light rays directed toward the screen 2 by the image-forming optical system 3 is reflected by the reflection surface of the movable mirror 4. At this time, if the movable mirror 4 is made to swivel about its longitudinal axis in such a manner that the normal N passing the center M of the movable mirror 4 normally passes the inner center of an imaginary triangle the vertexes of which consist of the principal point H of the image-forming optical system 3, the center M of the movable mirror 4 and the center P of the surface of the drum 5, the normal N consistently coincides with the direction of a bisector with respect to ∠ HMP. Accordingly, after the light rays have passed the principal point H and have been reflected from the center point M of the movable mirror 4, the light rays normally passes the center P of the surface of the drum 5 even if the movable mirror 4 is moved in the direction of its width. In addition, since various abberations such as a spherical abberation are eliminated from the image-forming optical system 3, a clear image is formed all over the surface of the screen 2. Accordingly, if the movable mirror 4 is made to travel by means of the mirror moving device in such a manner that the sum x + y of the optical path length x as between the principal point H and the center M of the movable mirror 4 and the optical path length as between the center M of the movable mirror and the center P of the surface of the drum 5 coincides with the distance $l\sec\theta$ of the straight line extending from the principal point H through the center M of the movable mirror 4 to the screen 2, the reflected light rays can be applied to the point P in the previously-described manner, thereby forming a clear image on the point P by means of the reflected light rays.

As described above, in accordance with the present invention, as the movable mirror is made to swivel about its axis and travel transversely with respect to the pencil of light rays shone by the image-forming optical system. Accordingly, if the drum is rotated in synchronism with the speed of travel of the movable mirror, the image recorded on the film is formed on the screen and at the same time the same image as that formed on the screen can be recorded over a predetermined area of the surface of the drum in a photosensitive manner.

Therefore, in accordance with the present invention, as one visually inspects the image formed on the screen, he/she can record the same image on the photosensitive surface of the drum. In addition, since a single movable mirror is employed, a compact optical system can be realized.

Figure 2:
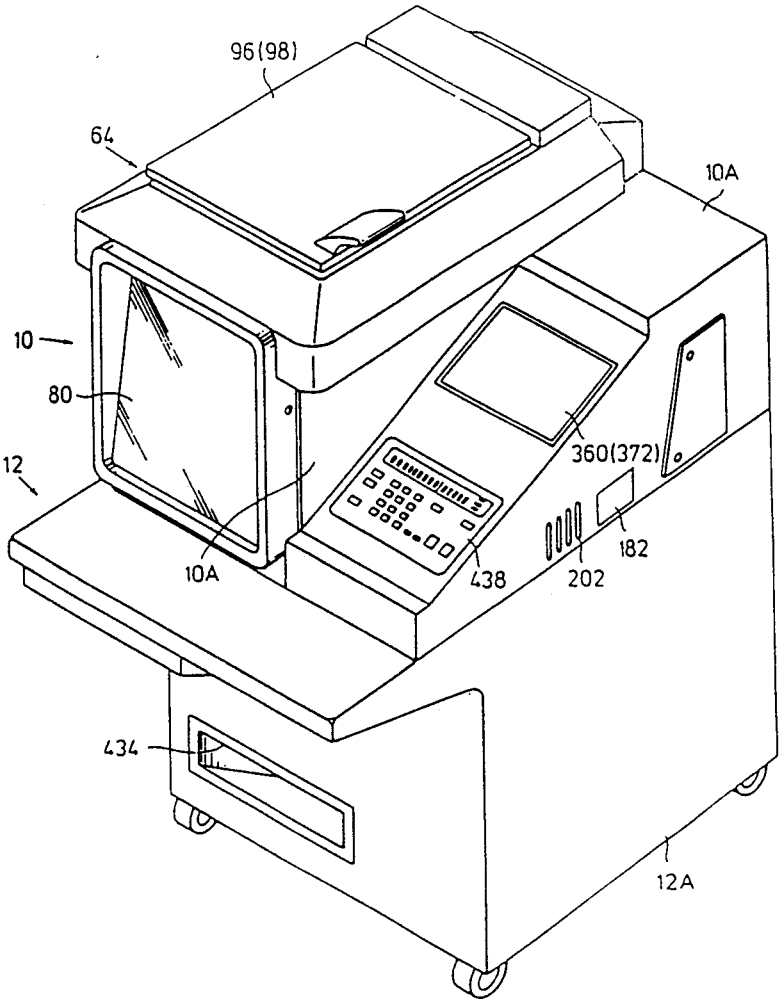
Figure 3:
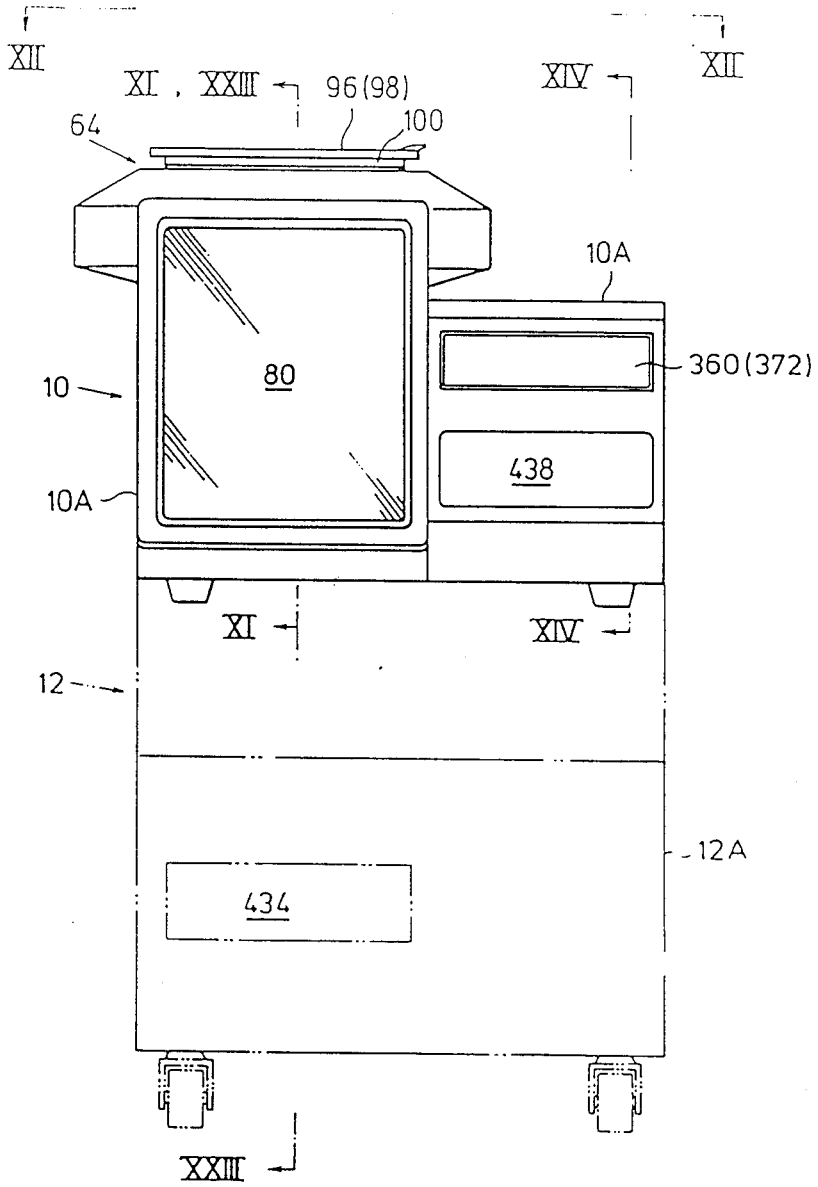

FIG. 2 is a perspective view of the external appearance of the whole of the projecting, recording and copying apparatus, and FIG. 3 is a front elevational view of the apparatus shown in FIG. 2. The projecting, recording and copying apparatus shown in FIG. 2 has an integral structure essentially constituted by a projecting and recording apparatus body 10 and a copying machine 12 having a housing 12A serving also as a table for mounting the body 10. It is to be noted that the projecting and recording apparatus body 10 may be used in the form of a separate unit as shown by the solid line in FIG. 3.

The presently preferred embodiment of the invention will be described below in detail.

(Cassette)

Figure 4:
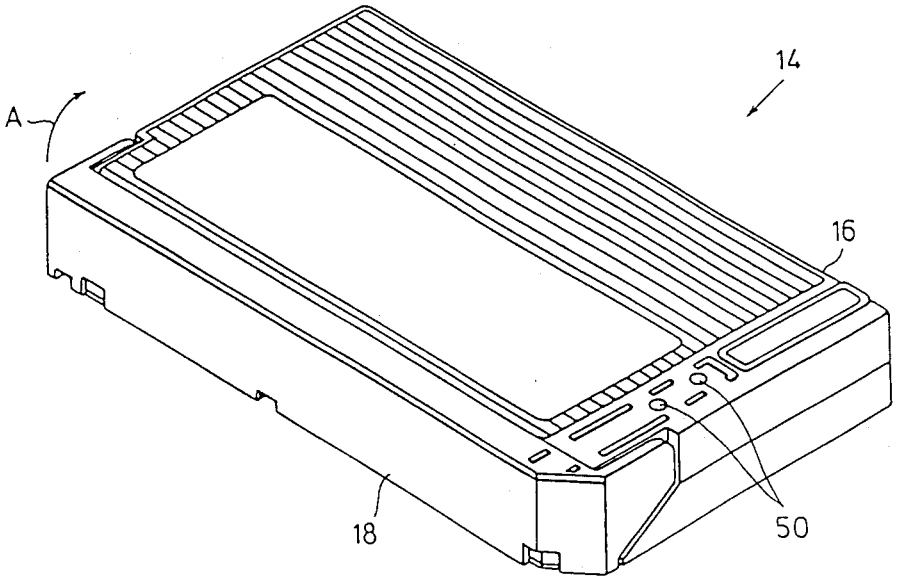
Figure 5:
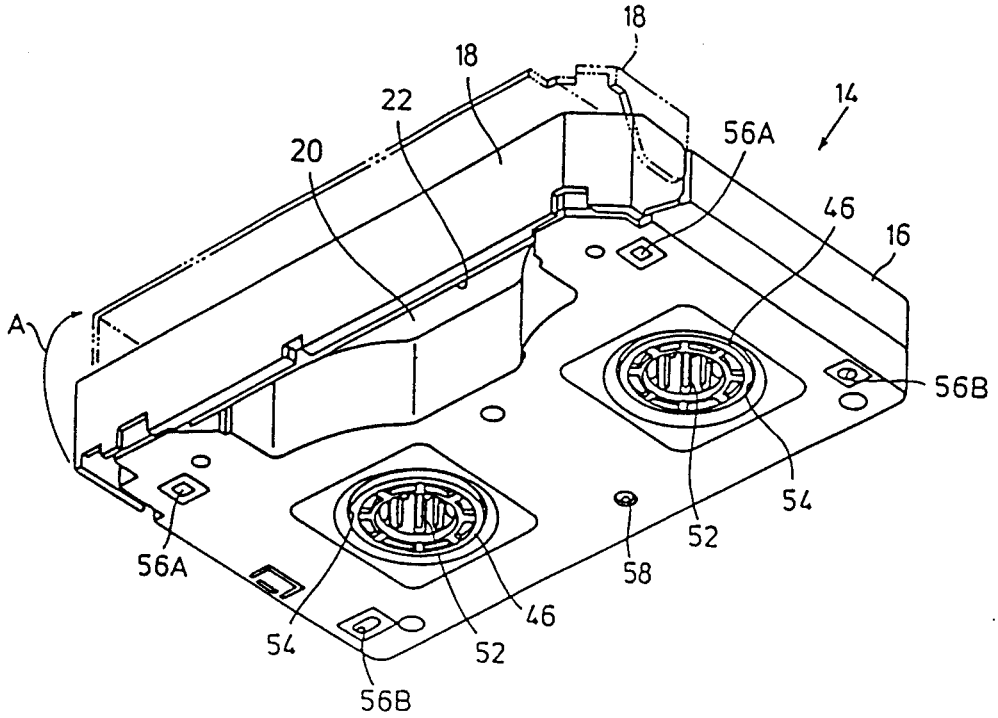

FIGS. 4 and 5 show a cassette which is loaded in the projecting and recording apparatus. FIG. 4 is a perspective view of the external appearance of the cassette as viewed from the upper side thereof, and FIG. 5 is a perspective view of the cassette as viewed from the reverse side thereof.

A cassette 14 has a guard panel 18 disposed on the front side thereof. The guard panel 18 is pivotally supported at both longitudinal ends thereof by a cassette casing 16 so that the panel 18 is able to pivot in the direction of the arrow A. As shown in FIG. 4, the cassette casing 16 has a recess 20 which opens in both the front and reverse sides. The intermediate portion of a tape 22 which is accommodated inside the cassette casing 16 extends through the recess 20 in the lateral direction of the cassette casing 16. A portion of the tape 22 which is positioned in the recess 20 is exposed at the front side of the cassette casing 16 when the guard panel 18 is pivoted in the direction of the arrow A.

Figure 6:
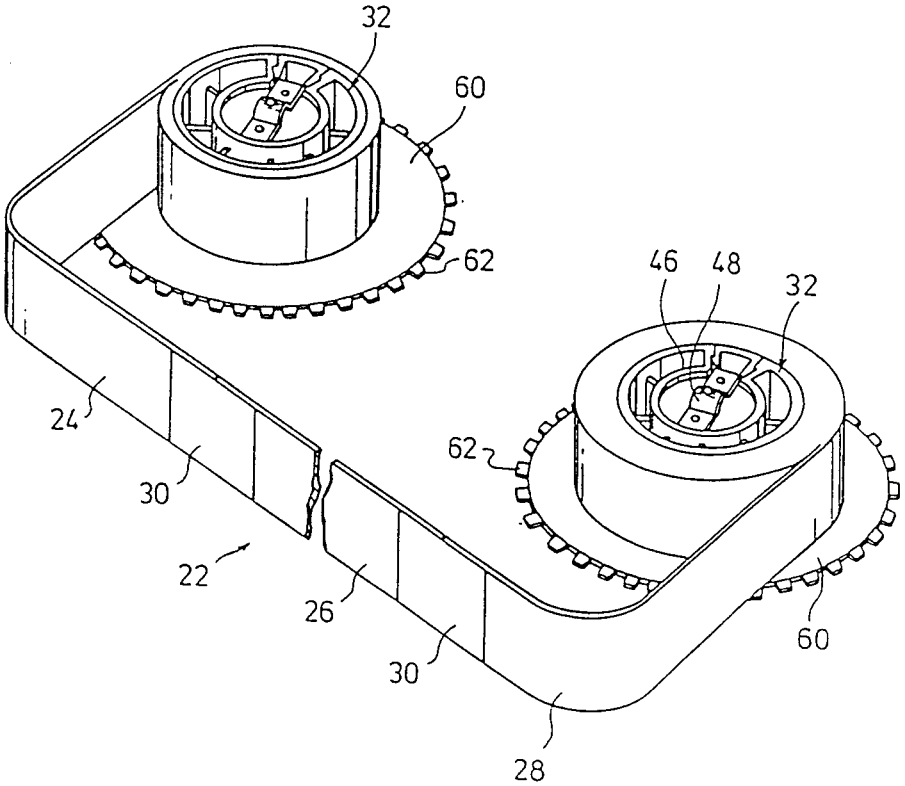

Referring to FIG. 6, the tape 22 is essentially constituted by a leader tape 24, a magnetic tape 26 and an electrophotographic film 28, which are spliced together along the longitudinal direction of the tape 22 by pieces of splicing tape 30. Both end portions of the tape 22 are respectively retained by a pair of reels 32 which are accommodated by the cassette casing 16 so that the tape 22 is wound on the reels 32.

Figure 7:
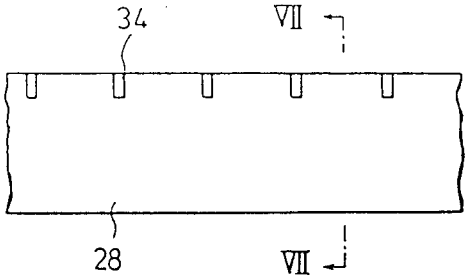
Figure 8:
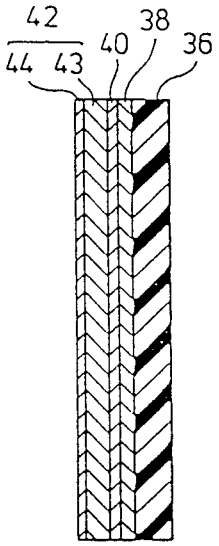

As shown in FIG. 7, the electrophotographic film 28 is printed with blip marks 34 along the upper edge thereof at predetermined regular spacings in the longitudinal direction of the film 28 (no blip marks 34 are shown in FIG. 6). As will be clear from FIG. 8 (a sectional view taken along the line VII—VII of FIG. 7), the electrophotographic film 28 includes a transparent base 36 (with a thickness of about 75 μm) made of, e.g., polyethylene, and an optically transparent, electrically conductive thin layer 38 formed on the base 36 by evaporation or other similar means. Furthermore, a photosensitive layer 42 (with a thickness of about 9 μm), which becomes electrically conductive when it receives light, is formed on the electrically conductive layer 38 with an intermediate layer 40 interposed therebetween. The photosensitive layer 42 is essentially constituted by a photoconductive layer 43 (with a thickness of about 8 μm) and a protective coat 44 (with a thickness of about 1 μm) for protecting the layer 43. The electrophotographic film 28 is disposed in such a manner that, when the film 28 is positioned in the recess 20 defined in the cassette casing 16, the side of the film 28 which is closer to the photoconductive layer 43 faces the guard panel 18. It should be noted that the electrophotographic film shown in FIG. 7 is not necessarily limitative, and any known type of electrophotographic film may be employed.

As shown in FIG. 6, a contact piece 48 is secured to a boss portion 46 of each reel 32. The contact piece 48 provides electrical connection between the optically transparent, electrically conductive layer 38 of the electrophotographic film 28 and external contacts 50 (see FIG. 4) exposed at the upper surface of the cassette casing 16. As shown in FIG. 5, each boss portion 46 the shape of a tube the bottom of which is opened, and projecting walls 52 are formed on the inner peripheral wall of the boss portion 46 at equal spacings. The boss portions 46 are respectively positioned in through-holes 54 provided in the bottom of the cassette casing 16 in such a manner that the boss portions 46 are exposed to the outside of the cassette casing 16.

The bottom of the cassette casing 16 is, as shown in FIG. 5, provided with a pair of positioning projections 56A which come into contact with positioning pins, respectively, a pair of positioning holes 56B each closed at one end thereof which receive positioning pins, respectively, and a through-hole 58 for receiving a brake releasing pin. When the pin is inserted into the through-hole 58, a brake mechanism is released which engages with rectangular projections 62 formed on the outer periphery of a flange portion 60 of each of the reels 32 (see FIG. 6) to prevent rotation of the reels 32.

(Optical Systems in Projecting, Recording and Copying Apparatus)

Figure 9:
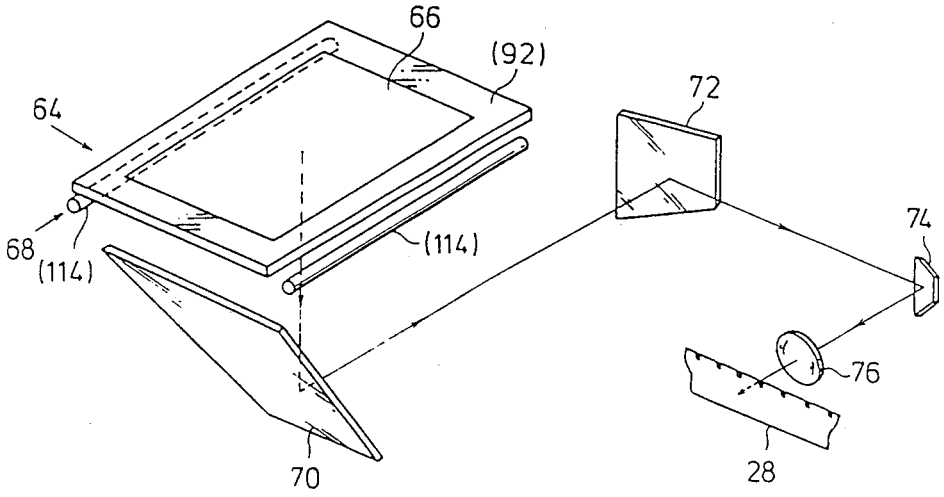
Figure 10:
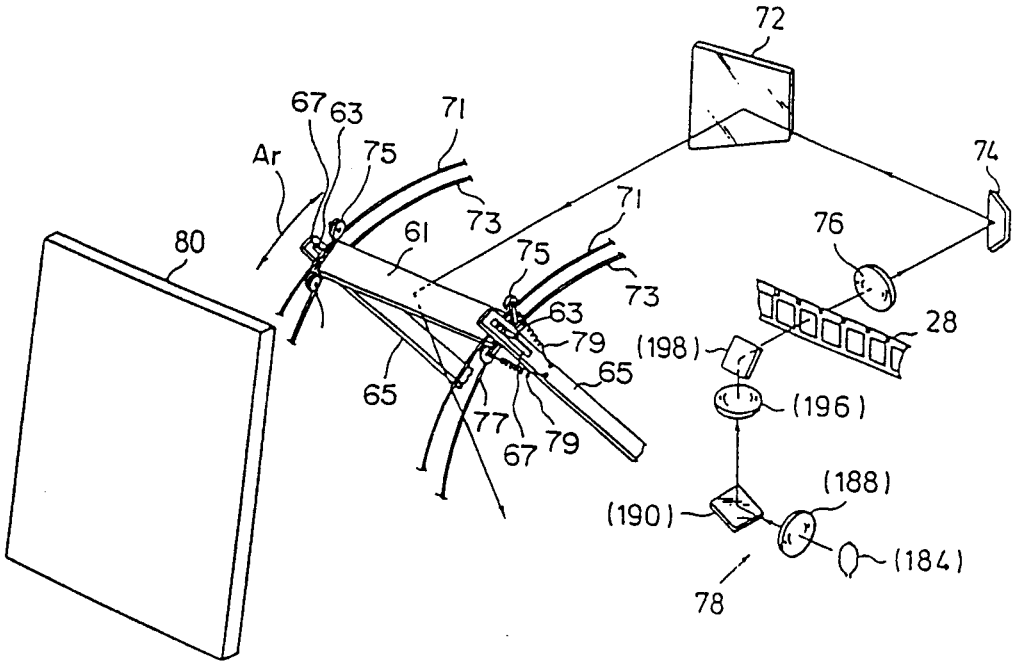
Figure 11:
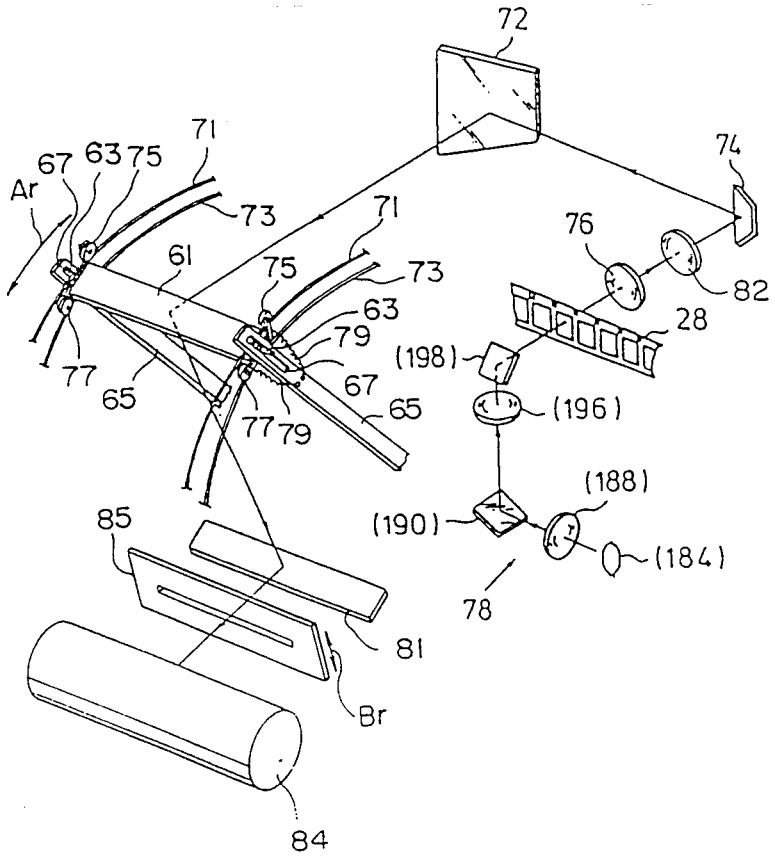

FIGS. 9 to 11 schematically show various optical systems in the projecting, recording and copying apparatus, respectively.

Referring first to FIG. 9, a recording optical system includes a document illuminating apparatus 68 according to the present invention which illuminates a document 66 as a subject which is set on a document table 64, a third mirror 70 on which the light reflected from the document 66 is made incident, a second mirror 72 on which the light reflected from the third mirror 70 is made incident, a first mirror 74 on which the light reflected from the second mirror 72 is made incident, and a main lens 76 for focusing the light reflected from the first mirror 74 on the surface of the electrophotographic film 28.

Referring next to FIG. 10, a projecting optical system includes a projecting light source section 78 for illuminating the electrophotographic film 28, the main lens 76 for focusing the light passing through the film 28 on the first mirror 74, the second mirror 72 on which the light reflected from the first mirror 74 is made incident, and a screen 80 on which the light reflected from the second mirror 72 is projected.

As shown in FIG. 11, a copying optical system includes, the projecting light source section 78, the main lens 76, the first mirror 74, the second mirror 72, a conversion lens 82 disposed between the main lens 76 and the first mirror 74 to slightly reduce the optical image formed on the first mirror 74, a movable mirror 61 and a fixed mirror 8, the light which has been reflected from the second mirror 72 being reflected from the mirrors 61 and 8 toward a sheet of copying paper 86 wound around a photosensitive drum 84 of a copying machine 12 (see FIGS. 1 and 2). The fixed mirror 8 is provided for turning an image upside down, for example, in a transfer step such as the transfer of toner images performed in the process of forming an focused image into the final image. If the reversal of an image is not needed, the fixed mirror 8 may be omitted. The movable mirror 61 has rods 63 at its longitudinal ends, the rods 63 projecting longitudinally therefrom. Arms 65 are disposed adjacent to the longitudinal ends of the movable mirror 61, slots 6 being respectively formed in the end portions of the arms 65 such that the rods 63 are inserted into the slits 6. The arms 65 are connected to a swiveling device (not shown) for causing the arms 65 to swivel in the directions of the double-headed arrow Ar shown in FIG. 10. First guide rails 71 and second guide rails 73 are disposed adjacent to the longitidunal ends of the movable mirror 61. In addition, respective pairs of first rollers 75 and second rollers 77 are rotatably mounted on the longitudinal ends of the movable mirror 61, the first guide rollers 75 being guided along the first guide rails 71 with the second guide rollers 77 guided along the second guide rails 73. One end of the movable mirror 61 is normally biased toward the associated second guide rail 73 by a pair of tension springs 79 each having one end fixed to the arm 65. A movable member 85 formed with a slit is disposed between the fixed mirror 81 and the drum 84 in such a manner as to be moved in the directions of the double-headed arrow Br shown in FIG. 11 in synchronism with the speed of travel of the movable mirror 6.

Figure 12A:
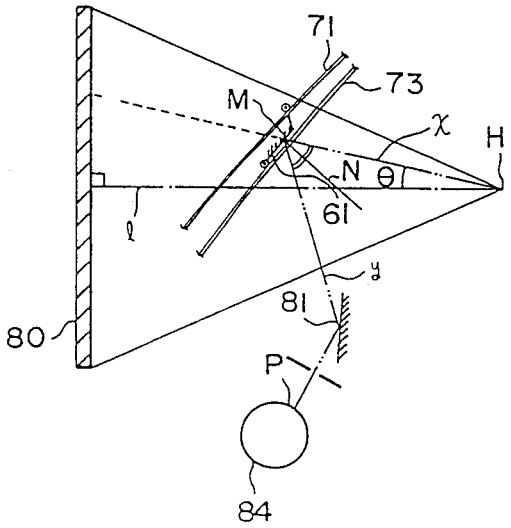
FIG. 12A is a diagram, showing respective guide rails for carrying a movable mirror according to the invention, so as to aid in the explanation of the formula of the curve along which respective guide rails are formed.

Referring to FIG. 12A, the aforesaid first guide rails 71 and the aforesaid second guide rails 73 are respectively provided with curves which are selected so as to fulfill the following requirements. As shown in FIG. 12A, if l represents the principal point of the optical system constituted by the main lens 76 and the conversion lens 82, representing the length of the perpendicular drawn from the principal point H to the screen 80, x representing the optical path length as between the principal point H and the center M of the movable mirror 61, $\theta$ representing the angle formed by the aforesaid perpendicular and a straight line connecting the principal point H and the center M of the movable mirror 61, P representing the center of the surface of the drum 84 and y representing the optical path length extending from the center M of the movable mirror 61 through the fixed mirror 81 to the center P of the surface of the drum 84, (1) $x + y = l\sec\theta$, and (2) the normal N passing the center M of the movable mirror 61 nomrally passes the inner center of a triangle the vertexes of which are constituted by the principal point H, the center M of the movable mirror 61 and the center P of the surface of the drum 84. It is to be noted that, although the first guide rails 71 serve as guide means for holding the movable mirror 64 at a position corresponding to the center M, if the requirement set forth in item (2) is fulfilled, this construction need not necessarily be employed.

Accordingly, when the movable mirror 61 is caused to travel in the directions of the double-headed arrow Ar shown in FIG. 11 by swiveling the arm 65, the movable mirror 61 is moved along the guide rails 71 and 73. Since the respective gaps between the associated guide rails 71 and 73 are progressively enlarged as shown, the light rays passing through the film 28 are applied to the point P of the drum 84, thereby illuminating the drum 84 in the form of a strip parallel to the axis thereof. Since the optical path length between the principal point H and the screen 80 consistently equals the optical path length between the principal point H and the surface of the drum 84, the image recorded on the film 28 is formed on the aforesaid strip-shaped portion of the drum 84. In consequence, if the rotational speed of the drum 84 is controlled in synchronism with the speed of travel of the movable mirror 61, the image recorded on the film 28 is copied all over the surface of a sheet of copying paper.

During this time, the angle $\theta$ changes with time and therefore, if the variation is represented by $\theta(t)$, the drum 84 is rotated at a speed required to fulfill $l\tan\theta(t) = R \cdot W \cdot T$; where R representing the radius of the drum 84, W representing the angular velocity of the drum 84 and t representing the time. It should be noted that the rotational speed of the drum 84 could be controlled by known control means such as a pulse motor, a cam or the like.

Figure 12B:
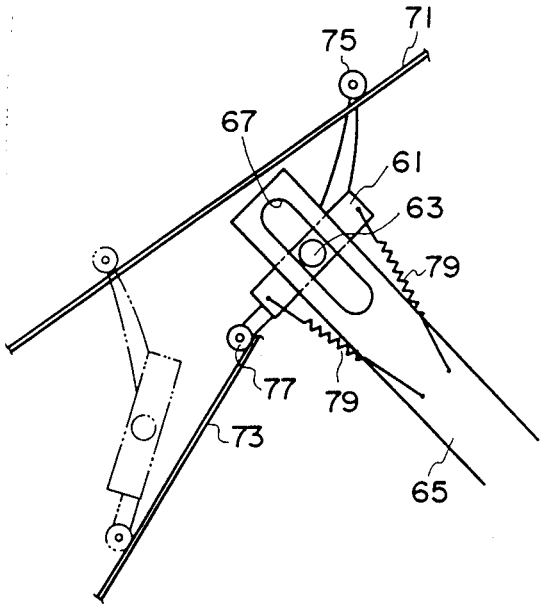
FIG. 12B is an enlarged, schematic view of one longitudinal end of the movable mirror and associated elements according to the invention.

FIG. 12B is an enlarged, schematic view of one longitudinal end of the movable mirror 61 and its associated portion.

Figure 12C:
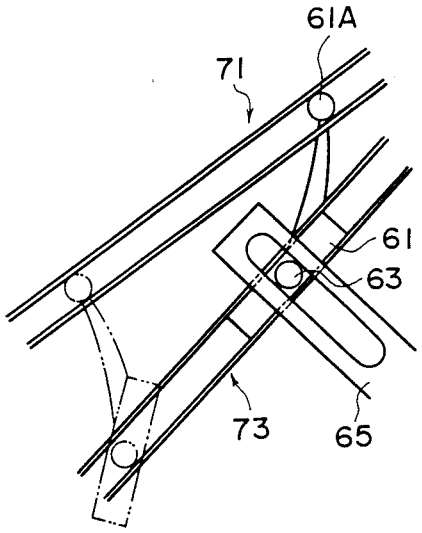
FIG. 12C is another enlarged, schematic view similar to that of FIG. 12B, but showing a modified form for the associated elements for causing the movable mirror according to the invention to travel in a swiveling manner.

FIG. 12C is a view similar to FIG. 12B, but showing a modified form for causing the movable mirror 61 to travel in a swiveling manner. In this illustrated arrangement, the ends of the guide rails 71 and 73 are constituted by a pair of guide rails. The rods 63 are made to slide along the guide rails 73 while sliding members 61A fixed to the movable mirror 61 is made to slide along the guide rails 71. Therefore, the mirror 61 is capable of being moved about the straight line passing through the center M of the movable mirror 61.

The main lens 76 and the first and second mirrors 74, 72 are commonly used for the above-described three optical systems, and they are fixedly disposed within the housing 10A of the projecting and recording apparatus body 10 (see FIGS. 2 and 3). The third mirror 70, the movable mirror 61, the conversion lens 82 and the screen 80 are also disposed within the projecting and recording apparatus body 10 and selectively used. The third mirror 70, the movable mirror 61 and the conversion lens 82 are movably disposed within the housing 10A so that they are prevented from interfering with any other optical system, whereas the screen 80 is fixedly disposed at the front side of the housing 10A since it does not interfere with other optical systems.

(Document Table)

Figure 13:
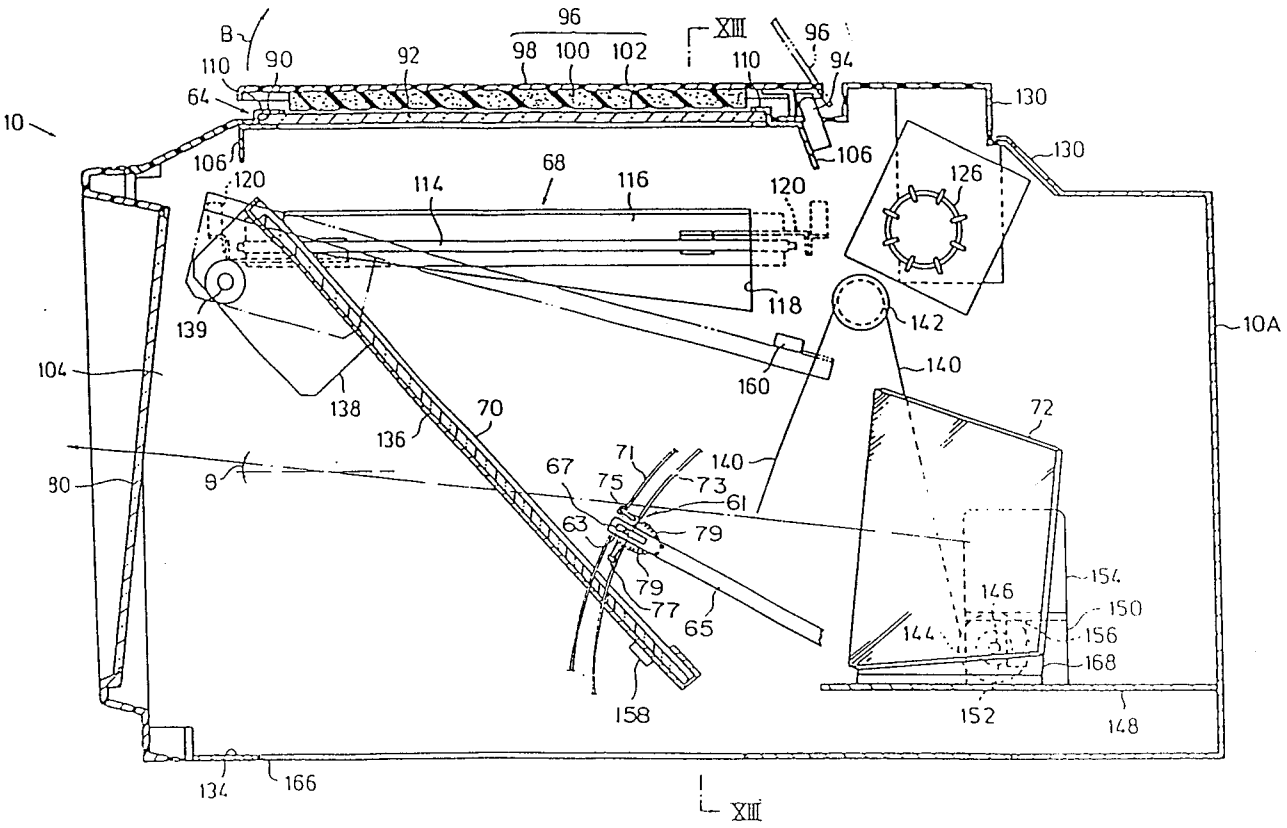

As shown in FIGS. 2 and 3, the document table 64 is disposed on the left upper side of the projecting and recording apparatus body 10. Referring to FIG. 13 (a sectional view taken along the line XI—XI of FIG. 3), the document table 64 includes a transparent glass plate 92 disposed in such a manner as to cover a relatively large upper opening 90 provided in the upper side of the housing 10A of the projecting and recording apparatus body 10, and a document pressing plate 96 which is disposed in such a manner as to cover the upper surface of the glass plate 92 and which is able to be opened in the direction of the arrow B by means of an opening and closing member 94. The document pressing plate 96 is essentially constituted by a cover 98, a cushioning member 100 made of a sponge material and bonded to the cover 98, and a white pressing sheet 102 bonded to the cushioning member 100.

The glass plate 92 is supported at the periphery of the reverse side thereof by a mounting bracket 106 which is rigidly secured to side frames 104 provided on a base frame 134 in such a manner as to extend upwardly in opposing relationship to each other. The inner surface of the bracket 106 is painted in white. It should be noted that the opening and closing member 94 is also rigidly secured to the mounting bracket 106.

Figure 14:
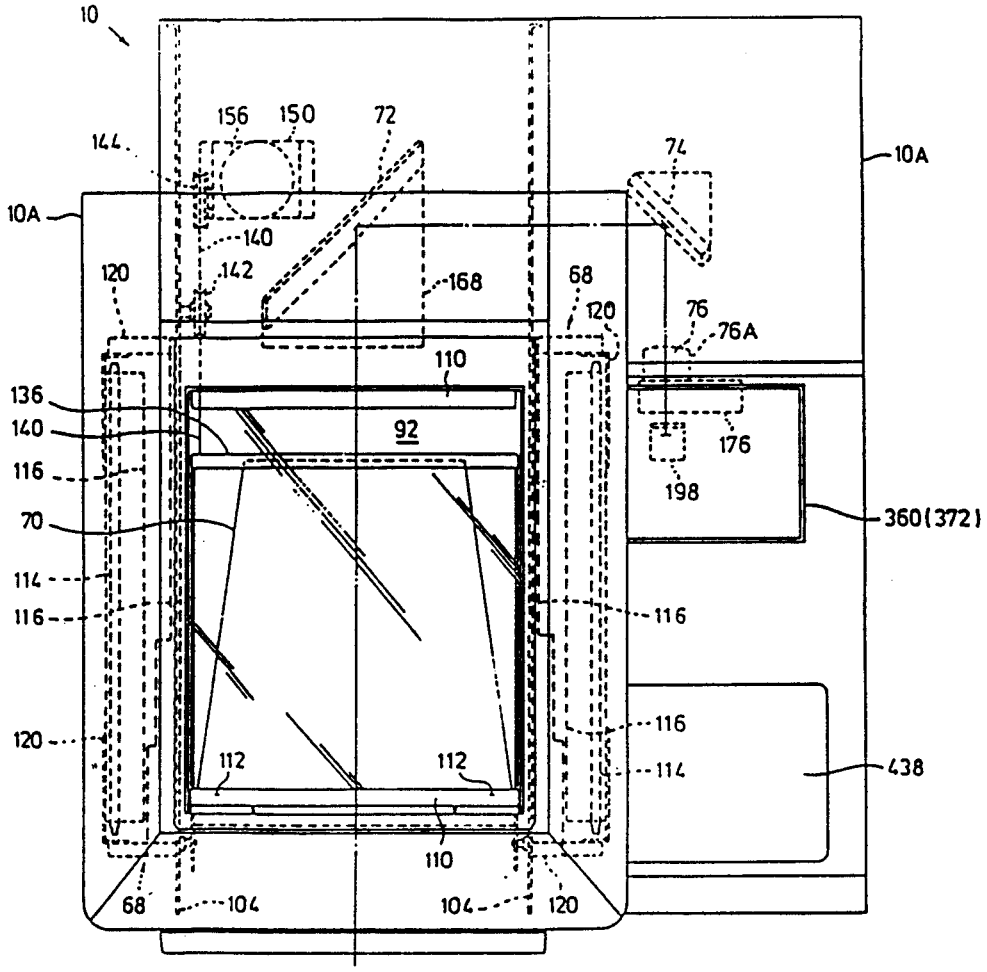

As shown in FIG. 14 (a sectional view taken along the line XII—XII of FIG. 3, showing the apparatus with the document pressing plate 96 being removed), thin-walled frame plates 110 for clamping the aforesaid glass plate 92 together with the mounting bracket 106 are respectively disposed at the front and rear end portions of the upper side of the glass plate 92. Document positioning marks 112 are provided on the frame plate 110 positioned at the front end. The inner side surfaces of the frame plates 110 are also painted in white.

Since the respective inner sides of the mounting bracket 106 and the frame plates 110 are painted in white, when the document 66 set on the document table 62 (see FIG. 9) is recorded on the electrophotographic film 28, the light reflected from the portions painted in white is applied to the peripheral portion of a frame of the film 28 which is subjected to recording, and the peripheral portion is thereby exposed to light. In consequence, since the peripheral portion is exposed to light in this manner, no black frame is produced when the frame formed with an image is developed. (Document Illuminating Assembly)

Referring FIGS. 13, 14 and 15 (a sectional view taken along the line XIII—XIII of FIG. 13), the document illuminating assembly 68 according to the present invention is disposed below the document table 64. The document illuminating assembly 68 includes illuminating lamps 114, reflecting plates 116 for reflecting the light emitted from the lamps 114, and aperture masks 118 which are respectively formed in side frames 104 in order to allow the light from the lamps 114 to uniformly illuminate the document 66 (see FIG. 9).

The respective illuminating lamps 114 have a tubular configuration and are disposed below and on both sides of the glass plate 92 in such a manner that the lamps 114 extend parallel to the glass plate 92 in the longitudinal direction thereof. Both end portions of each illuminating lamp 114 are respectively supported by brackets 120 which are rigidly secured to the corresponding side frames 104. Each reflecting plate 16 is also supported by the corresponding one of the brackets 120 and extends in the longitudinal direction of the glass plate 92 in such a manner as to cover the upper and lower and outer side portions of the corresponding lamp 114 as shown in FIG. 15. The light emitted from each illuminating lamp 114 is applied to the document 66 set on the upper surface of the glass plate 92 through the opening in the associated aperture mask 118.

The respective aperture masks 118 are designed to prevent non-uniform illumination of the document 66 which might be attributed to the arrangement in which the third mirror 70 is slanted with respect to the document table 64 in face-to-face relationship with each other. More specifically, the lower edge of the opening in the mask 118 is slanted downward from the left-hand side toward the right-hand side as viewed in FIG. 13 so that the right- and left-hand portions (as viewed in FIG. 13) of the aperture mask 118 have different heights.

For the same reason as in the case of the aperture mask 118, reflection plates 116 located on the lower sides of the respective illuminating lamps 114 are, as shown in FIG. 14, enlarged in width in a stepped manner so as to increase their reflecting areas from the lower side toward the upper side as viewed in FIG. 14 for the purpose of preventing lowering in the illuminance of the light reflected from the portion of the document 66 which faces the lower end portion of the third mirror 70. The aforesaid configuration of the lower reflection plates 116 need not necessarily be limited to the step-like configuration, and it is a matter of course that they may, for example, be tapered.

Figure 15:
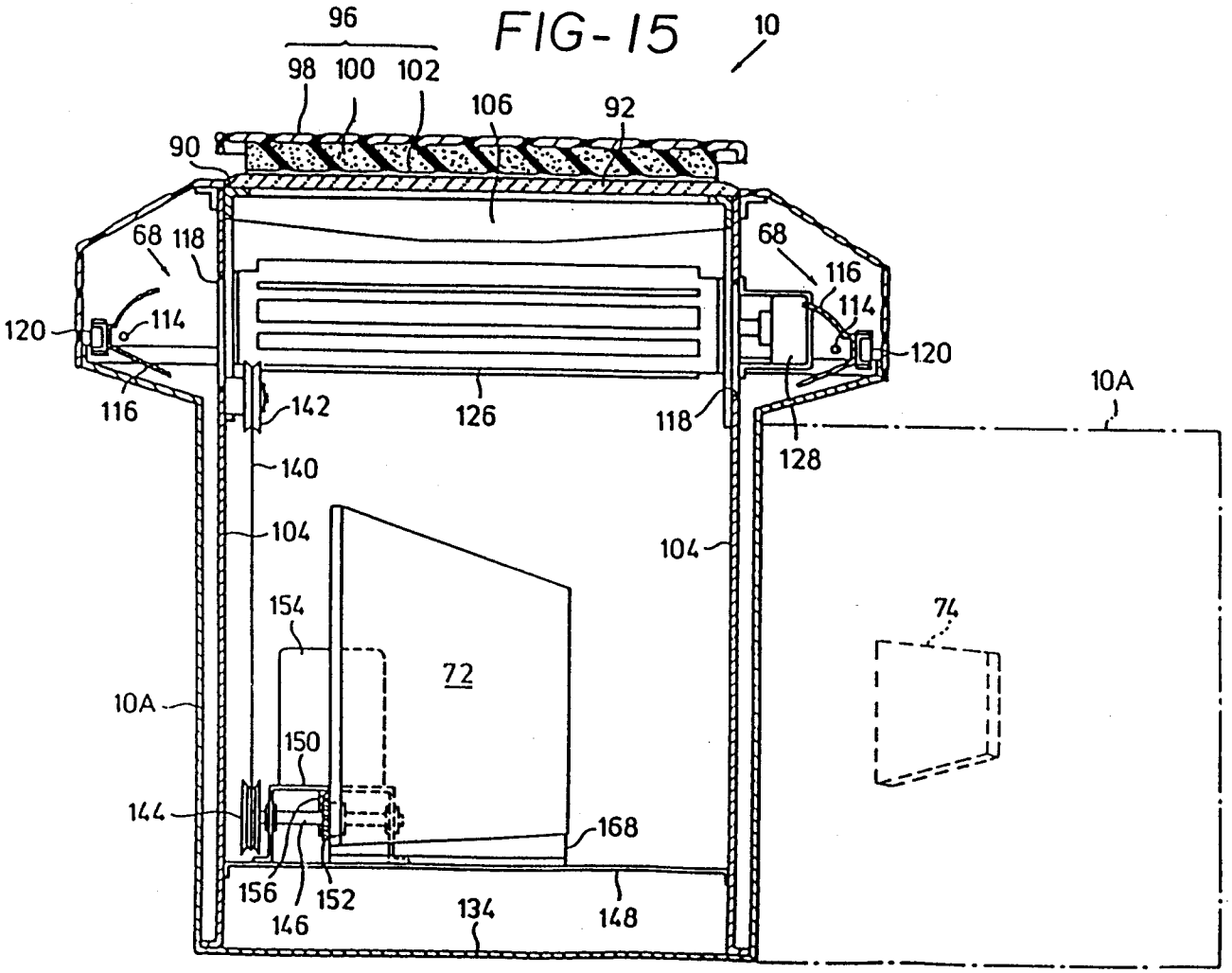

To prevent lowering in illuminance at the central portion of the document 66 located at a position which is remote from both the illuminating lamps 114 (the central position between the right and left illuminating lamps 114 as viewed in FIG. 15), the substantially central portion of the mounting bracket 106 is, as shown in FIG. 15, extended further downwardly as compared with the other end portions of the same so that the bracket 106 functions as an auxiliary reflecting plate.

As shown in FIGS. 13 and 15, a cooling fan 126 is disposed inside the housing 10A of the projecting and recording apparatus body 10 in such a manner that both end portions of the fan 126 are respectively supported by the side frames 104 disposed in opposing relation to each other. The cooling fan 126 is provided for the purpose of cooling the illuminating lamps 114 which have heated up and the atmosphere inside the housing 10A which has been raised in temperature by the lamps 114. The cooling fan 126 is driven by a motor 128 secured to the reverse side of one of the side frames 104 as shown in FIG. 15 so as to discharge the warm air inside the housing 10A through a louver 130 shown in FIG. 13.

(Screen Mirror lens)

As shown in FIGS. 2 and 3, the screen 80 is disposed at the left front side of the projecting and recording apparatus body 10 in such a manner that a line perpendicular to the surface of the screen 80 is inclined at an angle $\theta$ with respect to a base frame 134 of the body 10 as shown in FIG. 13. The screen 80 is of the translucent type in which an image which is projected from the rear side of the screen 80 is viewed in the form of transmitted light from the front side, i.e., the outside of the screen 80.

Referring to FIG. 14, the third mirror 70 is defined by a trapezoidal plane mirror, and fixed to a mirror frame 13 as shown in FIGS. 13 and 14. Brackets 138 are rigidly secured to both lateral edges, respectively, of the left-hand end portion (as viewed in FIG. 13) of the mirror frame 136. The brackets 138 are pivotally supported on the opposing side frames 104 by means of pins 139, respectively. One end of a wire 140 is retained by the right-hand end (as viewed in FIG. 13) of the mirror frame 136, i.e, the free end thereof. The intermediate portion of the wire 140 is passed over a pulley 142 which is rotatably supported by one of the side frames 104, and the other end of the wire 140 is retained by a take-up pulley 144.

The take-up pulley 144 is, as shown in FIG. 15, rigidly secured to one end portion of a shaft 146. The shaft 146 is rotatably supported by a bracket 150 with a substantially hat-shaped cross-section which is rigidly secured to a first subbase frame 148. A worm wheel 152 is rigidly secured to the intermediate portion of the shaft 146. The worm wheel 152 is meshed with a worm 156 which is rigidly secured to the shaft of a motor 154 mounted on the bracket 150. It should be noted that the first subbase frame 148 is rigidly secured at both ends thereof to the opposing side frames 104, respectively, the frame 148 being positioned above the base frame 134.

The third mirror 70 is pivoted together with the mirror frame 136 which is pivoted about the pins 139 in response to the movement of the wire 140 which is wound up and unwound from the take-up pulley 144, between the lower-limit position shown by the solid line in FIG. 13 and the upper-limit position shown by the chain line in the same Figure. Lower and upper limit switches 158 and 160 are secured to one of the side frames 104, the switches 158 and 160 being adapted to come into contact with the mirror from 136 at the lower and upper limit positions, respectively, of the third mirror 70.

The base frame 134 is provided with a bottom opening 166. The projecting and recording apparatus body 10 and the copying machine 12 (shown in FIGS. 2 and 3) spatially communicate with each other through the bottom opening 166 and another opening 166A (see FIG. 25) provided in the copying machine 12.

As shown in FIGS. 13 and 14, the second mirror 72 is defined by a trapezoidal plane mirror and rigidly secured to the first subbase frame 148 through the intermediary of a bracket 168. The second mirror 72 is inclined at an angle $\theta$ with respect to the base frame 134 in a manner similar to that of the screen 80 and at the same time, the second mirror 72 is, as shown in FIG. 14, inclined at an angle of 45° with respect to the longitudinal axis of the projecting and recording apparatus body 10.

Figure 16:
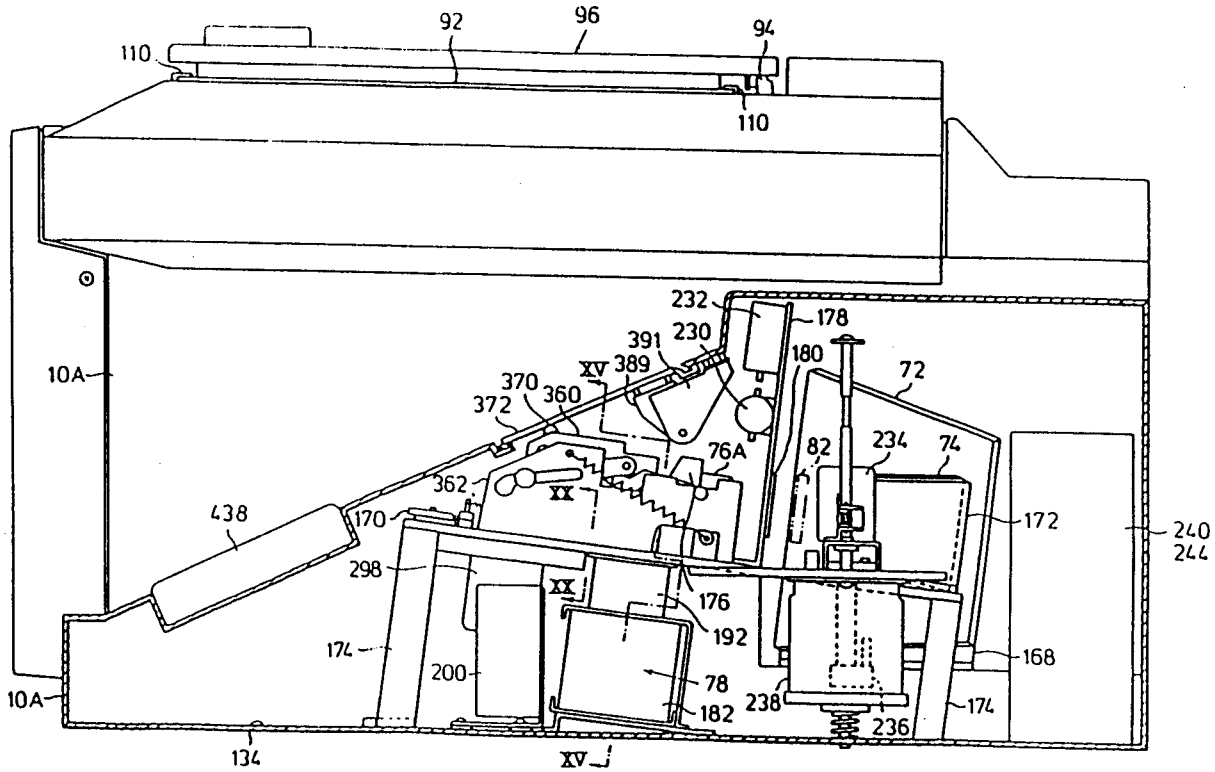

As shown in FIGS. 14 and 16 (a sectional view taken along the line XIV—XIV in FIG. 3), the first mirror 74 is similarly defined by a trapezoidal plane mirror and rigidly secured to a second subbase frame 170 (see FIG. 16) through the intermediary of a bracket 172. The first mirror 74 is inclined at an angle $\theta$ with respect to the base frame 134 and at the same time, the mirror 74 is inclined at an angle of 45° with respect to the longitudinal axis of the projecting and recording apparatus body 10 as shown in FIG. 14 in a manner similar to that of the second mirror 72. The second subbase frame 170 is, as shown in FIG. 14, rigidly secured to the base frame 134 by stays 174 in the state of being inclined at an angle $\theta$ with respect to the base frame 134.

As shown in FIG. 16, the main lens 76 is incorporated in a lens barrel 76A and rigidly secured to the second subbase frame 170 together with a processing head 176 in one unit. The main lens 76 is disposed in such a manner that the optical axis thereof is inclined at an angle $\theta$ with respect to the base frame 134.

The conversion lens 82 is, as shown in FIG. 16, disposed between the first mirror 74 and the main lens 76, and adapted to be movable by a moving mechanism (not shown) between two positions, that is, a position at which the optical axis thereof is coincident with that of the main lens 76 and a position at which the lens 82 does not interfere with the lens 76.

As shown in FIG. 16, a bulkhead 178 is provided on the second subbase frame 170 in such a manner as to extend in a direction perpendicular to the frame 170, and a shutter 180 is disposed on the bulkhead 178 so that it is possible to shut the optical path defined between the main lens 76 and the first mirror 74. The shutter 180 is connected to an automatic exposure controller (not shown).

(Projecting Light Source Section)

Figure 17:
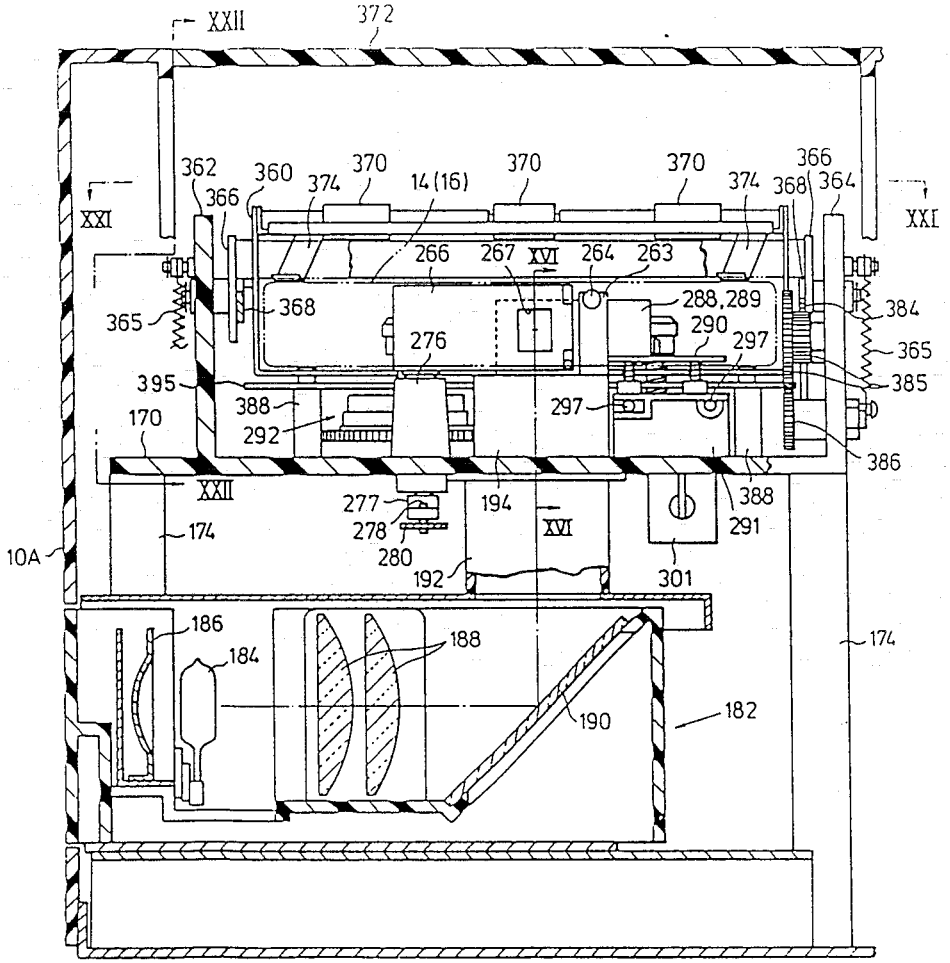

Referring to FIGS. 16 and 17 (a sectional view taken along the line XV—XV of FIGS. 16 and 23 which is described later), a lamp box 182 is disposed in the projecting light source section 78. The lamp box 182 is, as shown in FIG. 17, provided with a halogen lamp 184 which defines a light source, a reflecting plate 186 disposed at the rear side of the halogen lamp 184, condenser lenses 188 for condensing the light emitted from the halogen lamp 184, and a lower projecting mirror 190 adapted to reflect the light from the halogen lamp 184 at a right angle so that the light is projected upward.

It should be noted that a part of the lamp box 182 defines a part of a side wall of the housing 10A of the projecting and recording apparatus body 10 as shown in FIGS. 2 and 17 so that the lamp box 182 can be readily removed from the body 10 when, for example, the lamp 184 is replaced with a new one.

Figure 18:
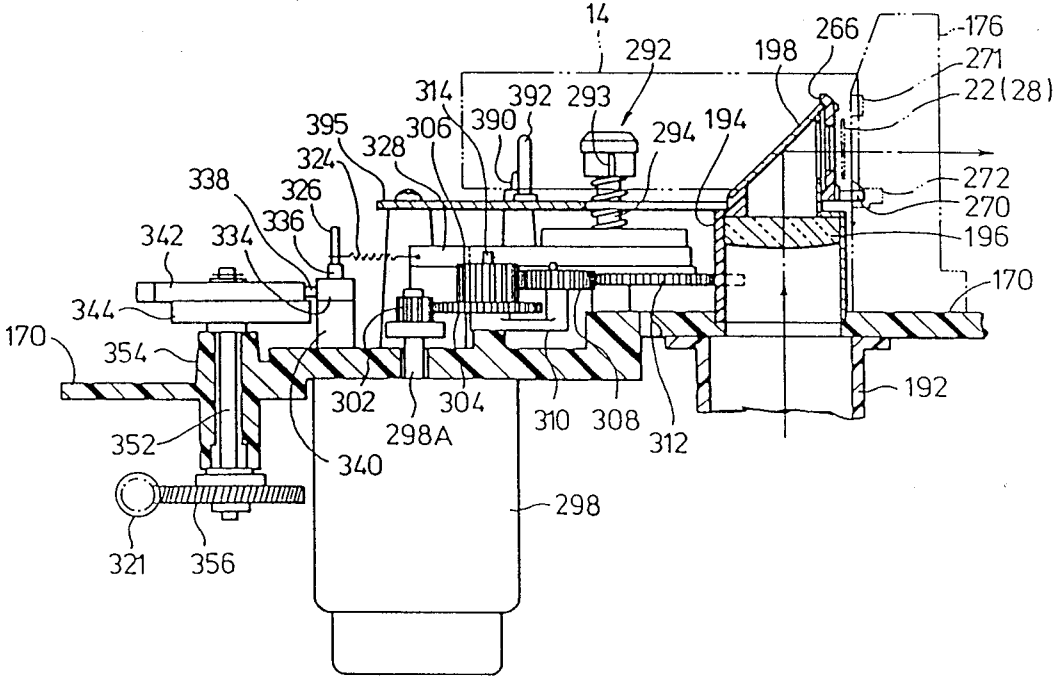

The projecting light source section 78 is essentially constituted by the lamp box 182, a tubular member 192, a tubular member 194 (see FIG. 15), and a condenser lens 196 as well as an upper projecting mirror 198 respectively supported by the intermediate and upper portions of the tubular member 194 as shown in FIG. 18 (a sectional view taken along the line XVI—XVI of FIG. 17). The tubular member 192 is suspended from the second subbase frame 170 in such a manner that the tubular member 192 extends between the frame 170 and the lamp box 182 to prevent scattering of the light from the halogen lamp 184 which passes through the inside of the tubular member 192.

The tubular member 194 is provided on the second subbase frame 170 in such a manner as to project upward therefrom. The inside of the tubular member 194 communicates with that of the tubular member 192, and an opening is provided in the upper part of the tubular member 194 so as to face the processing head 177 as shown in FIG. 18. Thus, the light from the halogen lamp 184 is first reflected by the lower projecting mirror 190 and condensed by the condenser lens 196 so as to be incident on the upper projecting mirror 198 from the lower side thereof, and the upper projecting mirror 198 reflects the light at a right angle so that the reflected light is projected toward the processing head 176.

As shown in FIG. 16, a cooling fan 200 is rigidly secured to the base frame 134 adjacent to the lamp box 182. The fan 200 is provided for the purpose of cooling the halogen lamp 184 which has heated up and the atmosphere within the housing 10A which has been raised in temperature by the halogen lamp 184. The warm air inside the housing 10A is discharged from the louver 202 shown in FIG. 1.

(Processing Head)

Figure 19:
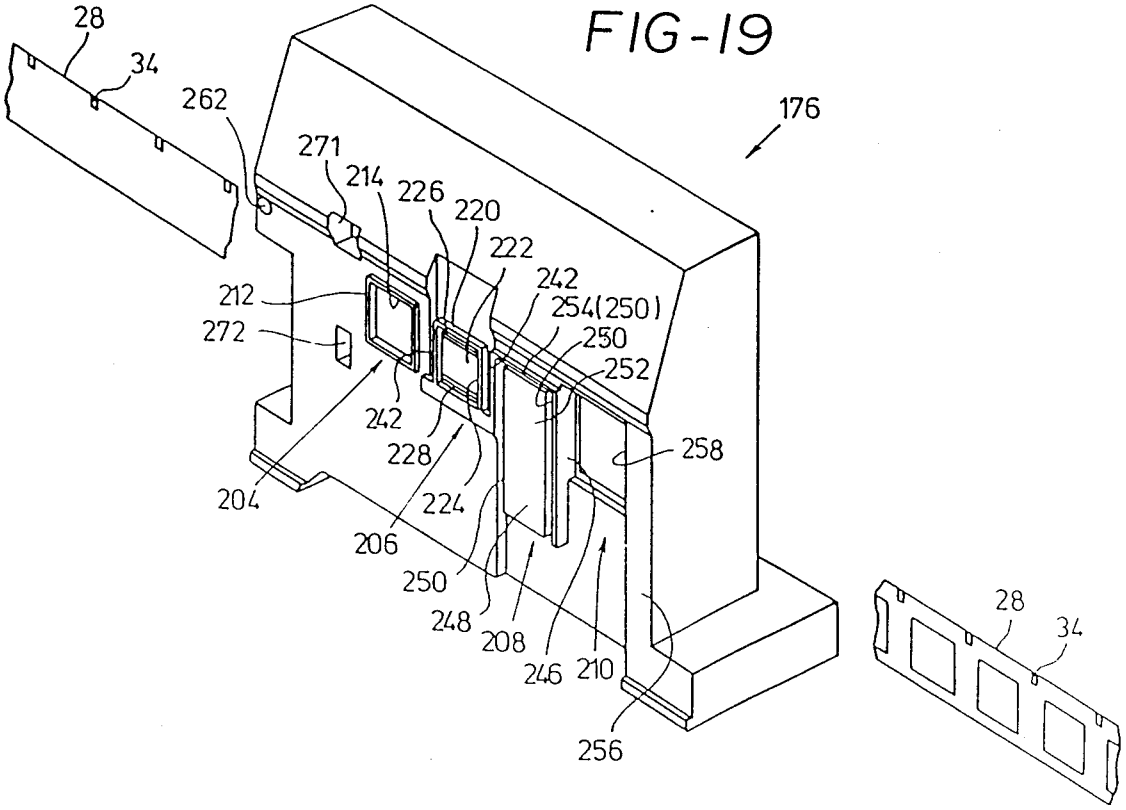
Figure 20:
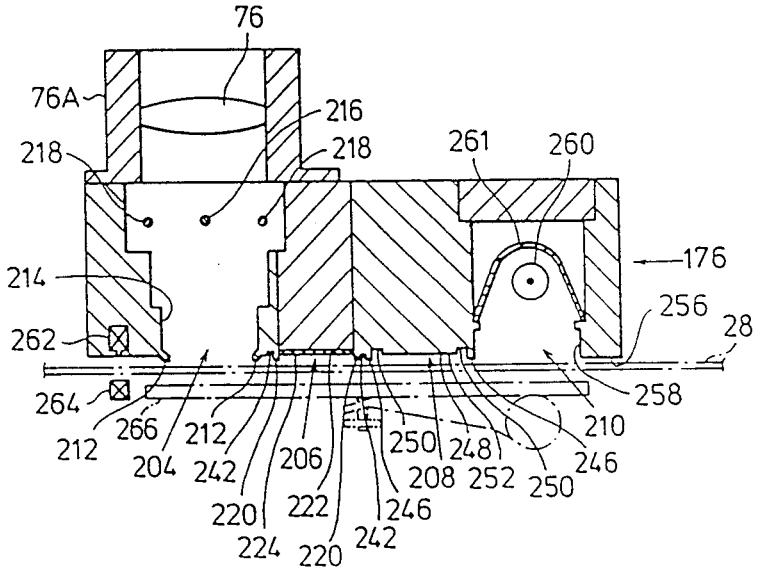

Referring to FIGS. 16 and 18, the processing head 176 is rigidly secured to the second subbase frame 170 in such a manner that the processing head 176 is disposed adjacent to the tubular member 194 as shown in FIG. 18. The processing head 176 is, as shown in FIGS. 19 and 20, provided with a charging exposure section 204, a developing section 206, a drying section 208 and a fixing section 210.

The charging exposure section 204 has a projecting frame 212 which is adapted to contact the edge portion of each frame of the electrophotographic film 28. A charging exposure chamber 214 is provided on the inner side of the projecting frame 212, the chamber 214 being defined by a space which extends horizontally (in the vertical direction as viewed in FIG. 20). In the charging exposure chamber 214 are disposed a corona wire 216 which extends vertically (in the direction perpendicular to the plane along which FIG. 18 is taken) and corona electrodes 218 disposed on both sides, respectively, of the corona wire 216. The main lens 76 is mounted on the processing head 176 through the intermediary of the lens barrel 76A on the opposite side to that on which the projecting frame 212 is formed. It should be noted that the optical axis of the main lens 76 is coincident with the center of the projecting frame 212. The charging exposure chamber 214 faces the upper projecting mirror 198 supported by the tubular member 194 as shown in FIG. 18.

The developing section 206 has a projecting frame 220. The width of the opening defined by the projecting frame 220 is set so as to become slightly smaller than that of the opening defined by the projecting frame 212. A developing electrode 222 which is formed from a metal sheet is disposed within the opening defined by the projecting frame 220. The developing electrode 222 is positioned in such a manner that the outer surface thereof is located at a position which is slightly inwardly of the end face of the projecting frame 220. The space surrounded by the projecting frame 220 and the developing electrode 222 defines a developing chamber 224. An opening is provided between the upper edge of the electrode 222 and the projecting frame 220 to define a developer inlet 226, and another opening is provided between the lower edge of the electrode 222 and the projecting frame 220 to define a developer outlet 228, the developer inlet and outlet 226, 228 having a width equal to that of the electrode 222.

The developer inlet 226 communicates with a developer tank 232 through a solenoid valve 230 shown in FIG. 16. The developer tank 232 communicates with a developer bottle 238 in which a developer is stored by means of a pump 236 driven by a motor 234. The developer is formed by dispersing finely divided toner particles in a solvent. A charging regulator is mixed with the developer so that the toner particles can be readily charged negative. The developer outlet 228 communicates with the developer bottle 238. Air which is pumped from a pressure squeezing pump 240 is discharged from the developer inlet 226.

Recesses 242 are respectively provided in the right and left sides of the projecting frames 220. An opening is provided in a part of each of the recesses 242, communicating with a suction squeezing pump 244. It should be noted that pipes for connecting various devices or members are not shown in FIG. 16.

The drying section 208 has a projecting frame 246. The projecting frame 246 is essentially constituted by an upper frame member and right and left frame members and has no lower frame member. The width of the opening defined by the projecting frame 246 is set so as to become larger than that of the opening defined by the projecting frame 212. A wall 248 is formed inside the projecting frame 246 in such a manner that the surface of the wall 248 is located at a position which is slightly inwardly of the end face of the projecting frame 246. Recesses 250 are defined between the wall 248 and the projecting frame 246. The space surrounded by the projecting frame 246, the wall 248 and the recesses 250 defines a drying chamber 252. An opening is provided in the recess 250 which is located at the upper part of the wall 248 so as to provide a warm air outlet 254.

The fixing section 210 is defined between the right frame member (as viewed in FIG. 19) of the projecting frame 246 and a projecting wall 256 which defines the right-hand end portion of the processing head 176. The space in the fixing section 210 defines a fixing chamber 258. In the fixing chamber 258 are disposed a xenon lamp 260 and a reflecting plate 261 for reflecting the light emitted from the lamp 260. The width of the opening in the fixing chamber 258 is set so as to be larger than that of the opening in the drying chamber 252.

The respective end faces of the projecting frames 212, 220 and 246 are flush with each other. In addition, the charging exposure chamber 214, the developing chamber 224, the drying chamber 252 and the fixing chamber 258 are arranged so that consecutive frames of the electrophotographic film 28 are able to face these chambers, respectively, at the same time.

The processing head 176 has a blip sensor 262 which is disposed at a position on the left-hand end portion thereof (as viewed in FIG. 19) which is slightly above the upper end of the projecting frame 212 of the charging exposure section 204. The blip sensor 262 is defined by a light-receiving element and faces a sensor light source 264 disposed on a side pillar 263 which is integral with the tubular member 194 (see FIG. 17).

As shown in FIG. 20, a pressing plate 266 is disposed in front of the processing head 176. The pressing plate 266 is, as shown in FIG. 21, provided with a rectangular through-hole 267 which is a size smaller than the opening defined by the projecting frame 212 formed in the charging exposure section 204. The pressing plate 266 is disposed in such a manner that the through-hole 267 opposes the projecting frame 212.

Figure 21A:
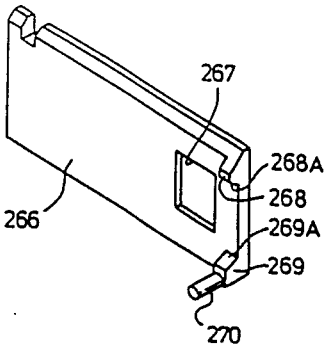
Figure 21:
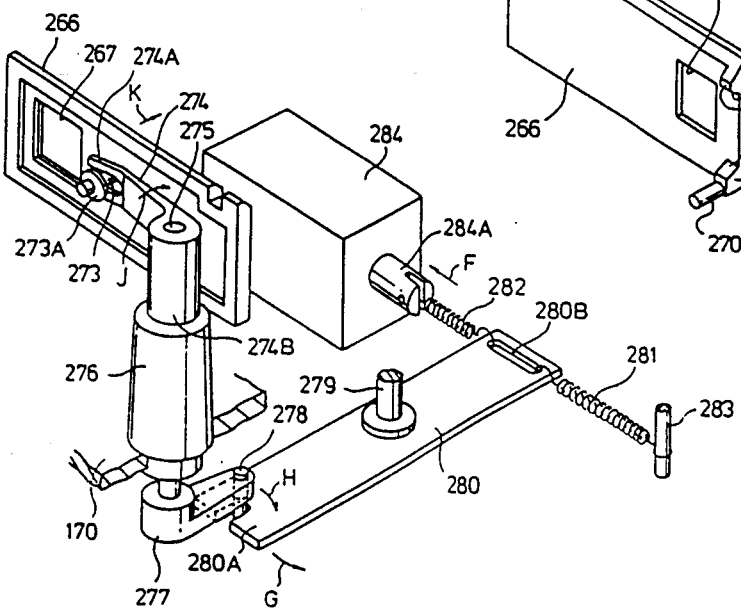

As will be clear from FIG. 21A (a perspective view of the pressing plate 266 shown in FIG. 21, as viewed from the opposite side), the pressing plate 266 has fitting members 268 and 269 respectively formed on the upper and lower end portions on the side of the plate 266 which is closer to the through-hole 267, the fitting members 268 and 269 projecting toward the processing head 176. The opposing inner surfaces of the fitting members 268 and 269 are slanted as shown by the reference numerals 268A and 269A. As shown in FIG. 18, the distance between the respective root portions of the upper and lower fitting members 268 and 269 is set so as to be equal to the width of the electrophotographic film 28 (strictly speaking, the aforesaid distance being slightly larger than the width of the film 28) for the purpose of accurately determining the heightwise position of the electrophotographic film 28. A columnar portion 270 projects from the distal end of the fitting member 269. The fitting members 268 and 269 are able to be fitted into bores 271 and 272, respectively, formed in the processing head 176, as shown in FIG. 19.

The pressing plate 266 has a columnar portion 273 projecting from the reverse surface thereof, that is, the surface thereof which is remote from the processing head 176. This columnar portion 273 is engaged with a notched portion 274A formed at one end portion of an arm 274. A stop ring 273A is rigidly secured to the distal end portion of the columnar portion 273 so as to prevent the arm 274 from coming off the columnar portion 273. A boss portion 274B is formed at the other end of the arm 274. A shaft 275 is rigidly secured to the boss portion 274B.

The shaft 275 is rotatably fitted into and thereby supported by a stand 276 projecting from the second subbase frame 170 to which the processing head 176 is secured, the lower end portion of the shaft 275 projecting from the reverse surface of the frame 170. A first lever 277 is rigidly secured to the projecting lower end portion of the shaft 275. A pin 278 is rigidly secured to the distal end portion of the first lever 277.

A shaft 297 is suspended from the reverse side of the second subbase frame 170. The shaft 279 pivotally supports the intermediate portion of a second lever 280. A notched portion 280A is formed at one end of the second lever 280, and the pin 278 is engaged with the notched portion 280A. A slot 280B is formed in the other end portion of the second lever 280, and one end portion of each of the tension coil springs 281 and 282 is retained by the slot 280B, the springs 281 and 282 biasing the second lever 280 in the opposite directions to each other so as to resiliently support the lever 280.

The other end portion of the tension coil spring 281 is retained by a pin 283 suspended from the reverse side of the second subbase frame 170, while the other end portion of the tension coil spring 282 is retained by a plunger 284A of a pull-type solenoid 284 which is secured to the reverse side of the frame 170.

When the solenoid 284 is not energized, the pressing plate 266 is separated from the processing head 176. In this state, the pressing plate 266 is supported in such a manner that the columnar portion 270 is fitted into the bore 272 formed in the processing head 176 as shown in FIG. 18. (Magnetic Head)

Figure 23:
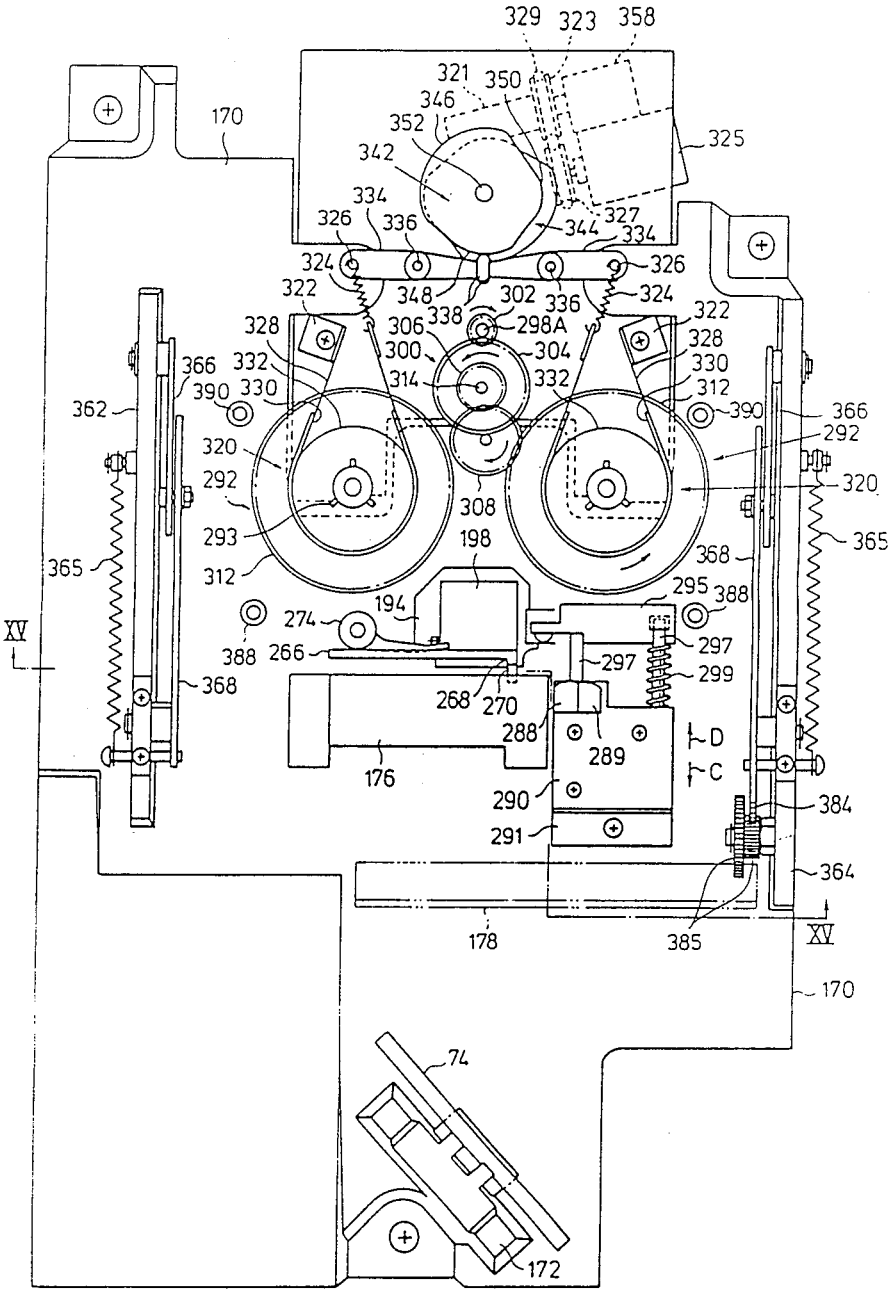

Referring to FIG. 23 (a sectional view taken along the line XXI—XXI of FIG. 17), a recording and reproducing magnetic head 288 and an erasing magnetic head 289 for the magnetic tape 26 are disposed adjacent to the processing head 176. The magnetic heads 288 and 289 are secured to a bracket 290 which, in turn, is mounted on a base 291 rigidly secured to the second subbase frame 170. The bracket 290 is adapted to be movable along a shaft 297 which is supported by the second subbase frame 170 through the intermediary of a member 295.

The bracket 290 is biased in the direction of the arrow C by means of a compression coil spring 299 wound on the shaft 297. However, when a solenoid 301, which is rigidly secured to the reverse side of the second subbase frame 170 as shown in FIG. 17, is energized, the bracket 290 is moved in the direction of the arrow D against the biasing force of the spring 299. The recording and reproducing magnetic head 288 and the erasing magnetic head 289 are positioned at the same level as that of the charging exposure chamber 214 and other chambers.

(Tape Driving Section)

Figure 22:
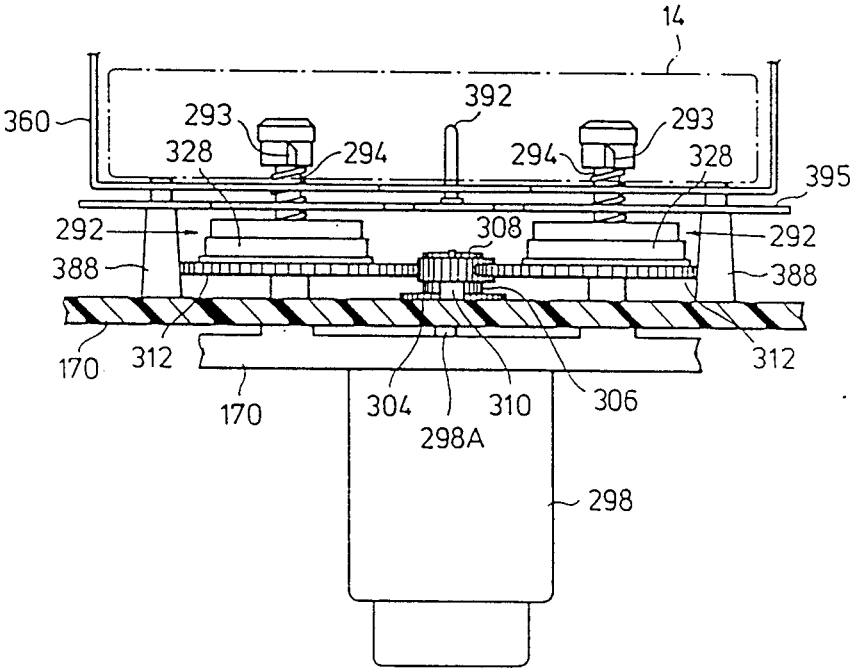

Referring to FIG. 22 (a sectional view taken along the line XX—XX of FIG. 16) and FIG. 23, a pair of reel tables 292 are disposed on the second subbase frame 170. Reel engaging projections 293 project radially from the top of each reel table 292. Each reel table 292 is rotatably supported by the second subbase frame 170 through a pin 294. Both the reel tables 292 can be rotated by a motor 298 (see FIG. 22) disposed on the reverse side of the second subbase frame 170 through a driving force transmission mechanism 300.

As shown in FIGS. 18 and 23, the transmission mechanism 300 is essentially constituted by a gear 302 rigidly secured to a shaft 298A of the motor 298, a first intermediate gear 304, a second intermediate gear 306, a third intermediate gear 308, an oscillating plate 310, and gears 312 which are defined by the respective lower disk portions of the reel tables 292.

The first and second intermediate gears 304 and 306 are coaxially connected together in one unit and rotatably supported by a pin 314 which projects upward from the second subbase frame 170. The oscillating plate 310 is interposed between the second subbase frame 170 and the first intermediate gear 304 and pivotally supported by the pin 314. The third intermediate gear 308 is rotatably supported by the oscillating plate 310.

The gear 302 is meshed with the first intermediate gear 304, and the second intermediate gear 306 is meshed with the third intermediate gear 308 which, in turn, is meshed with either one of the gears 312 on the reel tables 292 in accordance with the direction of rotation of the motor 298.

As shown in FIG. 23, a band brake 320 for applying back tension to the tape 22 is disposed on each of the reel tables 292. The band brake 320 has a steel sheet band 328 retained at one end thereof by the second subbase frame 170 through a retainer piece 322, the other end of the band 328 being retained by a pin 326 through a tension coil spring 324. A felt brake shoe 330 is bonded to the band 328. The brake shoe 330 is tightly wound on a cylindrical portion 332 of the reel table 292 under pressure by means of the tensile force applied from the tension coil spring 324.

The pin 326 projects upward from one end of an arm 334. The intermediate portion of the arm 334 is pivotally supported by a pin 336 projecting upward from the second subbase frame 170. An abutment piece 338 is formed at the other end of the arm 334. The band brakes 320 are respectively disposed on the pair of right and left reel tables 292 in symmetry with each other. As shown in FIG. 18, each arm 334 has a collar 340 which is fitted on the associated pin 336 to separate the arm 334 from the surface of the second subbase frame 170. Since the respective collars 340 of th two arms 334 have different heights, the arms 334 are disposed at different levels, so that their respective abutment pieces 338 overlap each other without any interference.

The abutment pieces 338 positioned in overlapping relation to each other are in pressure contact with cam plates 342 and 344, respectively. Each of the cam plates 342 and 344 has a large-diameter portion 346, an intermediate-diameter portion 348 and a small-diameter portion 350. The two cam plates 342 and 344 have the same configuration and are rigidly secured to a shaft 352 in such a manner that one of them is turned upside down and made out of phase with the other. The shaft 352 is received and thereby rotatably supported by a bearing portion 354 formed on the second subbase frame 170, the lower end portion of the shaft 352 projecting from the reverse side of the frame 170.

A worm wheel 356 is rigidly secured to the lower end portion of the shaft 352. The worm wheel 356 is meshed with a worm 321 which is rotatably supported in a cantilever fashion overhanding manner by a bearing member 358 secured to the reverse side of the second subbase frame 170. A pulley 323 is rigidly secured to a shaft which supports the worm 321. The pulley 323 is connected through a transmission belt 329 to a pulley 327 which is rigidly secured to the shaft of a motor 325 mounted on the reverse side of the second subbase frame 170.

(Cassette Loading Section)

Figure 24:
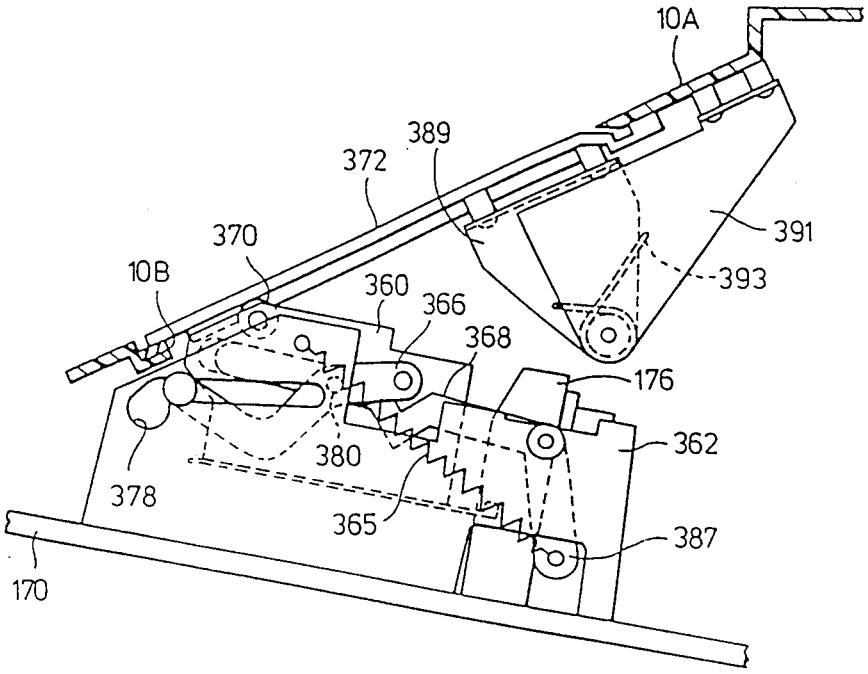

Referring to FIGS. 17 and 24 (a sectional view taken along the line XXII—XXII of FIG. 17), the cassette loading section has a cassette holder 360 for holding the cassette 14, cassette holder brackets 362, 364 which project upward from the second subbase frame 170 to support the cassette holder 360, and a pair of first arms 366 and a pair of second arms 368, which connect the cassette holder 360 and the cassette holder brackets 362 and 364.

Retaining members 374 made from metal leaf springs and adapted to resiliently retain the cassette 14 are secured to the right and left end portions, respectively, of the cassette holder 360. Two retainer members 374 are provided on one of the aforesaid right and left end portions in series relation to each other, and these retainer members 374 serve also as contact pieces which are brought into pressure contact with the external contacts 50 provided on the cassette 14. In addition, rollers 370 are rotatably disposed on the cassette holder 360. The cassette holder brackets 362 and 364 are respectively positioned on both outer sides of the pair of reel tables 292. As shown in FIG. 24, one end portion of each of the first arms 366 is movably supported by a slot 378 provided in the corresponding cassette holder bracket 362 or 364, and one end portion of each of the second arms 368 is pivotally supported by the bracket 362 or 364.

Figure 24A:
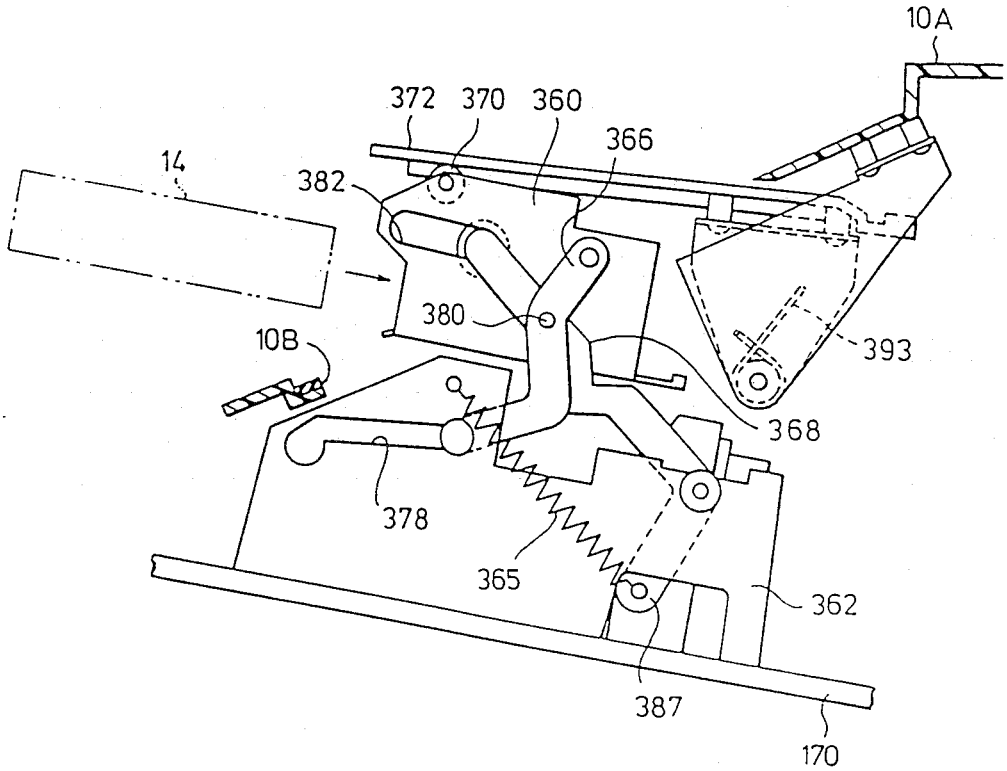
FIG. 24A is a sectional view, similar to FIG. 24, taken along the line XXII—XXII of 5 FIG. 17, but showing the state of operation of the internal structure of the projecting and recording apparatus body.

The corresponding first and second arms 366 and 368 are disposed in such a manner as to intersect each other, and pivotally connected together at the intersection by means of a pin 380. The other end portion of each of the first arms 366 is pivotally connected to the cassette holder 360. The other end portion of each of the second arms 368 is movably supported by a slot 382 provided in the cassette holder 360, as shown in FIG. 24A.

A sector gear 384 is, as shown in FIG. 23, formed on one end portion of one of the second arms 368 on the side thereof which is closer to the position at which the aforesaid arm 368 is pivotally connected to the associated cassette holder bracket 364. The sector gear 384 is meshed with a gear 385 which, in turn, is meshed with a rotary damper 386 as shown in FIG. 17. Both the gear 385 and the rotary damper 386 are secured to the cassette holder bracket 364.

In addition, each of the second arms 368 has a lever 387 extending from one end portion thereof which is closer to the position at which the arm 368 is pivotally connected to the corresponding cassette holder bracket 362 or 364. One end of a tension coil spring 365 is retained by the lever 387. The other end of the spring 365 is retained by the cassette holder bracket 362 or 364. Thus, each of the second arms 368 is biased so as to pivot clockwise as viewed in FIG. 24 about the position at which the arm 368 is pivotally connected to the corresponding cassette holder bracket 362 or 364, but the arm 368 is locked in the position shown in FIG. 24 by virtue of a stopper mechanism (not shown).

An opening 10B is provided in that portion of the housing 10A of the projecting and recording apparatus body 10 which is positioned above the cassette holder 360, and a cover 372 is disposed at the opening 10B. The cover 372 is pivotally mounted on the housing 10A through the intermediary of brackets 389 and 391 which are pivotally connected to each other. The cover 372 is biased counterclockwise as viewed in FIG. 24 by means of a torsion coil spring 393, and normally covers the opening 10B as shown in FIG. 24. In this state, the rollers 370 are in contact with the reverse side of the cover 372.

As shown in FIG. 23, two pairs of cassette positioning pins 388 and 390 are provided on the second subbase frame 170 in such a manner as to project upward around the reel tables 292. The top surfaces of the cassette positioning pins 388 abut against the positioning projections 56A, respectively, which are formed on the reverse surface of the cassette casing 16, thereby effecting positioning of the cassette 14 in the heightwise direction thereof, and the cassette positioning pins 390 are respectively fitted into the positioning holes 56B to effect positioning of the cassette 14 in the lateral direction thereof (in the direction which intersects both the pair of reel tables 292).

In addition, a cover 395 covers the reel tables 292 and the gears and other members of the transmission mechanism 300, and a brake release pin 392 which releases the brake mechanism of the cassette 14 is provided on the cover 395 so as to project therefrom upwardly.

(Copying Machine)

Figure 25:
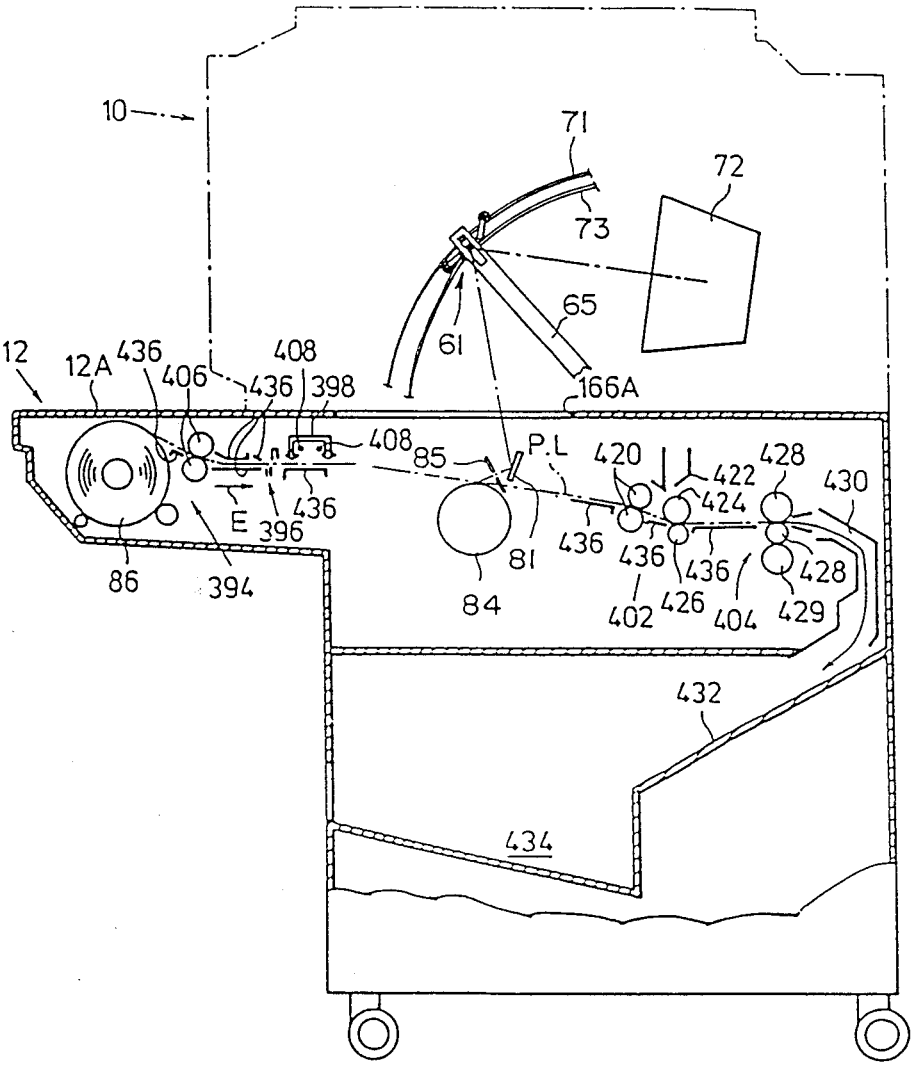

Referring to FIG. 25 (a sectional view taken along the line XXIII—XXIII in FIG. 3), the copying machine 12 has a paper feed section 394 in which a copying paper 86 (CPC paper) in the shape of a roll is disposed, a cutter 396 for cutting the copying paper 86 into sheets, a charging device 398 for charging each sheet of copying paper 86 cut by the cutter 396, the exposing drum 84 for supporting the charged sheet of copying paper 86 at an exposing position, a developing device 402 for developing the exposed sheet of copying paper 86, and a fixing device for fixing the developed sheet of copying paper 86.

A pair of feed rollers 406 are disposed in the paper feed section 394 to unwind the copying paper 86 in the shape of a roll and transport the paper 86 in the direction of the arrow E. A clutch (not shown) is associated with the feed rollers 406. Corona wires 408 for effecting corona discharge are disposed in the charging device 398. The exposing drum 84 is disposed below the aforesaid fixed mirror 81,,and the copying paper 86 thus transported is wound around the drum 84.

The developing device 402 has a pair of feed rollers 420, a toner tank 422 storing toner, a toner roller 424 having the peripheral surface to which is attached the toner from the toner tank 422, and a feed roller 426 disposed in opposing relation to the toner roller 424. The fixing device 404 consists of a pair of pressure rollers 428 an a back-up roller 429.

On the downstream side of the fixing device 404 are disposed a delivery passage 430 for guiding the sheet of copying paper 86 having been subjected to fixing process, a slope 432 for guiding the sheet 86 passed through the delivery passage 430, and a paper stacker 434 which has an opening provided in the front side of the copying machine 12.

It should be noted that, in FIG. 23, reference numeral 436 denotes a guide plate for guiding each sheet of copying paper 86, and reference symbol P.L denotes a path line of the copying paper 86.

In addition, the feed rollers 406 in the paper feed section 394, the driving shaft 410 in the exposing drum 84, the feed rollers 420, 426 and the toner roller 424 in the developing device 402, and the pressure rollers 428 and the back-up roller 429 in the fixing device 404 are simultaneously driven by means of a power transmitted thereto from a driving gear (not shown).

(Control Section)

As shown in FIGS. 2 and 3, a control keyboad 438 for controlling the projecting and recording apparatus is disposed on the projecting and recording apparatus body 10. On the control keyboard 438 are disposed, e.g., control buttons and display means for displaying numerals and an operating state of the apparatus.

(Operation of the Embodiment)

The following is a description of the operation of the projecting, recording and copying apparatus in accordance with this embodiment. The presently preferred embodiment of the projecting, recording and copying apparatus has the following major functions: the reader function by which the image recorded on an electrophotographic film accommodated by a cassette is projected onto a screen on an enlarged scale; the camera and processor function by which a document is photographed and the thus-formed image is thereby recorded on the electrophotographic film accommodated by the cassette; and the copy function by which the image recorded on the electrophotographic film accommodated by the cassette is copied on a sheet of copying paper similarly on an enlarge scale. The functions will be described below in the above order.

The operation of loading a cassette into the apparatus will first be explained.

When the power switch of the apparatus is turned on, the stopper mechanism (not shown) retaining the cassette holder 360 is released, so that the second arm 368, which are subjected to the biasing forces from the tension coil springs 365, are pivoted clockwise from the position shown in FIG. 24 about their respective portions at which they are pivotally connected to the cassette holder brackets 362 and 364, respectively, and the second arm 368 are thereby erected. In consequence, the other end portion of each of the second arms 368 is moved along the slot 382 formed in the cassette holder 360, and one end portion of each of the first arms 366 is moved along the slot 378 formed in the corresponding cassette holder bracket 362 or 364, thus causing the cassette holder 360 to be raised.

The cassette holder 360 causes the cover 372 to pivot against the biasing force from the torsion coil spring 393 while the rollers 370 are in rolling contact with the reverse side of the cover 372. In this way, the cassette holder 360 forces the cover 372 to open and springs out of the housing 10A of the projecting and recording apparatus body 10. During this movement of the cassette holder 360, the rotary damper 386 (shown in FIG. 17) acts so as to generate damping force. There is therefore no risk of any impact being generated when the cassette holder 360 is stopped in the position shown in FIG. 24A.

The cassette 14 is inserted into the cassette holder 360 in the direction of the arrow shown in FIG. 24A. After the cassette 14 has been completely inserted into the cassette holder 360, the cover 372 is pushed downward so as to be closed by a manual operation. As the cover 372 is moved downward, the second arms 368 are pivoted counterclockwise from the position shown in FIG. 24A against the biasing forces from the respective tension coil springs 365, and thereby flattened. In consequence, the first and second arms 366 and 382 are moved along the respective slots 378 and 382 in the reverse direction to the above, and the cassette holder 360 is thereby withdrawn into the housing 10A of the projecting and recording apparatus body 10, as shown in FIG. 24.

When the cover 372 is moved back to the position at which it closes the opening 10B provided in the housing 10A of the projecting and recording apparatus body 10, the cassette holder 360 is retained by the stopper mechanism (not shown). Accordingly, when the manual pushing operation is cancelled, there is no risk of the cassette holder 360 springing out. Thus, the loading of the cassette 14 into the projecting and recording apparatus body 10 is completed.

In this state, the cassette 14 is accurately positioned at a predetermined position in the projecting and recording apparatus body 10 by virtue of the positioning pins 388 and 390 shown in FIG. 23. Further, when the cassette 14 is in this state, the cassette casing 16 is raised by the positioning pins 388 and 390 so that the reverse surface of the cassette casing 16 is separated from the bottom of the cassette holder 360 as shown in FIG. 17. As the cassette casing 16 is moved upward from the bottom of the cassette holder 360, the retainer members 374 are brought into pressure contact with the upper surface of the cassette casing 16. Thus, the cassette casing 16 is resiliently held from the upper side thereof, and the electrophotographic film 28 is grounded through the projecting, recording and copying apparatus.

In the course of the cassette holder 360 being pushed in as described above, the guard pane 18 of the cassette 14 is brought into contact with a member (not shown) and thereby pivoted to the position shown by the chain line in FIG. 6. Therefore, when the cassette 14 is in a loaded state, the tape 22 is exposed at the front side of the cassette casing 16. The tubular member 194 is positioned within the recess 20 in the cassette casing 16 as shown in FIG. 18, and the tape 22 is therefore positioned in a gap defined between the processing head 176 and the pressing plate 266.

At the same time, the brake release pin 392 (see FIG. 22) projecting upward from the cover 395 enters the through-hole 58 provided in the reverse surface of the cassette casing 16 to release the brake mechanism (not shown) which has locked the reels 32 from rotating. Therefore, when the cassette 14 is in a loaded state, the reels 32 are rotatable in both clockwise and counterclockwise directions. In this state, furthermore, the projecting walls 52 formed on the boss portion 46 of each reel 32 are engaged with the reel engaging projecting 293 formed on the corresponding reel table 292 shown, for example, in FIG. 23.

The operation of positioning an electrophotographic film will next be explained.

In any case where an image is to be recorded on the electrophotographic film 28, or an image recorded on the film 28 is to be projected or copied, a frame concerned is positioned in front of the charging exposure chamber 214 of the processing head 176. Date concerning each of the frames on the electrophotographic film 28 has been recorded on the magnetic tape 26 spliced to the film 28 through the projecting and reproducing magnetic head 288, and it is therefore possible to read the data through the magnetic head 288.

To record or reproduce data, the solenoid 301 is energized so as to move the recording and reproducing magnetic head 288 in the direction of the arrow D shown in FIG. 23. against the baising force from the compression coil spring 299, and the magnetic head 288 is thereby brought into close contact with the magnetic tape 26.

When a frame which is to be positioned at the charging exposure chamber 214 is determined, this frame is designated by actuating the buttons on the control keyboard 438. In consequence, the motor 298 (see FIG. 22) in the tape driving section shown in FIG. 23 is activated to rotate. The rotation of the motor 298 is transmitted to the first intermediate gear 304 through the gear 302 and further transmitted to the second and third intermediate gears 306 and 308.

When the right-hand reel table 292 (as viewed in FIG. 23) is caused to rotate as a driving reel table counterclockwise, i.e., in the arrowed direction, the gear 302 is rotated clockwise, i.e., in the arrowed direction. In response to the rotation of the gear 302, the second intermediate gear 306 which is rotated counterclockwise together with the first intermediate gear 304 causes the third intermediate gear 308 to pivot counterclockwise about the axis of the pin 314. In response to the pivotal movement of the third intermediate gear 308, the oscillating plate 310 is also pivoted, and the third intermediate gear 308 is rotated clockwise. In this position, the third intermediate gear 308 is meshed with the gear 312 formed on the right-hand reel table 292 (as viewed in FIG. 23), and the reel table 292 is thereby rotated through the third intermediate gear 308.

When the left-hand reel table 292 (as viewed in FIG. 23) is caused to rotate as the driving reel table in the clockwise direction, the gear 302 is rotated counterclockwise, i.e., in the direction opposite to the above, and the oscillating plate 310 is consequently pivoted in the reverse direction to the above, thus causing the third intermediate gear 308 to mesh with the gear 312 formed on the left-hand reel table 292.

When one of the reel tables 292 is rotated, one of the reels 32 which is engaged with this reel table 292 is rotated, and the tape 22 is wound up around this reel 32. The tape 22 is unwound from the other reel 32, and this reel 32 is rotated as a supply reel while being pulled by the tape 22. Since an appropriate braking force is applied to each of the reel tables 292 by the associated band brake 320, an appropriate back tension acts on the pulled tape 22 through the driven-side reel table 292, so that there is no risk of the tape 22 sagging or being damaged.

It should be noted that the back tension is adjusted in such a manner that the motor 325 is driven to turn the cam plates 342 and 344 at a predetermined angle through the pulley 327, the transmission belt 329, the pulley 323, the worm 321, the worm wheel 356 and the shaft 352, thus causing the band brakes 320 to apply an optimum braking force to the respective reel tables 292.

More specifically, as the cam plates 342 and 344 are turned, the abutment pieces 338 are displaced following the large-diameter portions 346, the intermediate-diameter portions 348 and the small-diameter portions 350. Consequently, the arms 334 are pivoted in accordance with the amounts of displacement of the respective abutment pieces 338, thereby controlling the tension of the tension coil springs 324. The angle of rotation of the cam plates 342 and 344 is automatically controlled on the basis of the tape speed, and the amount of the tape 22 remaining on the supply reel 32, etc. so that a substantially constant back tension is obtained.

Thus, the tape 22 starts to travel by rotating the reel tables 292, and when the electrophotographic film 28 passes the processing head 176, the passage of blip marks 34 each formed for one frame is sensed by the blip sensor 262. In this embodiment, the number of sensed blip marks 34 is counted, and a designated frame is identified by an ordinal number counted from a starting frame. When the designated frame is positioned at the charging exposure chamber 214, the drive of the motor 298 is stopped, and the rotation of the reel tables 292 is thereby stopped.

The following is a description of the operation of recording the image of a document on an electrophotographic film.

In this state, the document pressing plate 96 of the document table 64 shown, e.g., in FIG. 13 is first opened, and the document 66 (see FIG. 9) is placed on the upper side of the glass plate 92 in alignment with the positioning marks 112 (see FIG. 14) in such a manner that the side of the document 66 which is to be recorded faces downward. When the document pressing plate 96 is closed, the document 66 is fixed on the document table 64, and the reverse surface and/or the periphery of the document 66 is covered with the white pressing sheet 102. At this time, in order to form the image of the document 66 on the film, the third mirror 70 is moved downward and positioned between the guide rails 71 and 73, thereby allowing for the switchover of the optical path.

When setting of the document 66 is completed, the camera mode is selected by actuating the buttons on the control keyboard 438. When the camera mode is selected, the motor 154 shown, e.g., in FIG. 13 is driven, and the take-up pulley 144 is thereby rotated by means of the worm 156, the worm wheel 152 and the shaft 146. As the take-up pulley 144 is rotated, the wire 140 is unwound from the pulley 144 in such a manner that the wire 140 is extended while the intermediate portion thereof is being guided by the pulley 142, thus causing the third mirror 70 to pivot clockwise from the position shown by the chain line in FIG. 13. The motion of the motor 154 is stopped when the mirror frame 136 comes into contact with the lower limit switch 158, and the third mirror 70 is stopped at the position shown by the solid line in FIG. 13.

When the pivotal movement of the third mirror 70 is stopped, the information that the preparation for recording has been completed is displayed on the control keyboard 438. When, in this state, the start button on the control keyboard 438 is pressed, the solenoid 284 shown in FIG. 21 is energized.

When the solenoid 284 is energized, the plunger 284A is activated to move in the direction of the arrow F, causing the tension coil springs 281 and 282 to be expanded against the biasing forces. In consequence, the second lever 280 is pivoted on the shaft 279 in the direction of the arrow G, so that the first lever 227 is pivoted on the pin 278 in the direction of the arrow H, thus causing the shaft 275 to turn in the same direction. Thus, the arm 274 is pivoted in the direction of the arrow J so as to press the pressing plate 266 in the direction of the arrow K.

The pressing plate 266 is moved in the direction of the arrow K while the columnar portion 270 is being guided along the bore 272, thus causing the electrophotographic film 28 to be pressed against the end faces of the projecting frames 212, 220 and 246. When the heightwise position of the film 28 is misaligned, the respective slanted surfaces 268A and 269A of the fitting members 268 and 269 act so as to push down the upper edge of the film 28 or push up the lower edge thereof as the pressing plate 266 is moved. While the pressing plate 266 is pressing the film 28 against the processing head 176, the fitting members 268 and 269 are respectively fitted into the bores 271 and 272, so that the film 28 is accurately positioned with respect to the processing head 176. In this state, the pressing plate 266 is allowed to resiliently press the film 28 by the action of the tension coil springs 281 and 282.

At the same time, a voltage is applied between the corona wire 216 and the corona electrodes 218 to generate corona discharge, thus causing the surface of the photosensitive layer 42 of the electrophotographic film 28 to be charged negative uniformly.

While the corona discharge is being carried out, the illuminating lamps 114 in the document illuminating device 68 are turned on to illuminate the document 66. The light emitted directly from the illuminating lamp 114 and the light reflected from a reflecting plate 116 are allowed to illuminate the document 66 through the opening portions of the respective aperture masks 118, so that the overall surface of the document 66 is uniformly illuminated. At the same time that the corona discharge is completed, the shutter 180 is opened, and an automatic exposure controller (not shown) starts integration of the quantity of light reflected from the document 66. When the integrated value of the quantity of light reaches a predetermined value, the automatic exposure controller generates a signal to close the shutter 180. At the same time, the controller generates a signal to turn off the illuminating lamps 114.

While the shutter 180 is open, the light reflected from the document 66 in accordance with the pattern of the image thereof is made incident on the third mirror 70, passed through the second mirror 72, the first mirror 74 and the main lens 76, and illuminating the.surface of the electrophotographic film 28 by means of the optical system shown in FIG. 9. Electric charge on the photosensitive layer 42 of the film 28 is reduced by the application of the light in accordance with the image pattern on the document 66, and an electrostatic latent image is thereby formed on the photosensitive layer 42.

Employment of the automatic exposure controller enables correction of factors in changes of the image density, such as variations in the ground density of the document 66 and variations in the voltage applied to the illuminating lamps 114, so that an optimal exposure operation is effected at all times.

After the shutter 180 has been closed, the solenoid 284 is de-energized by means of a controller (not shown). In consequence, the second lever 280, which is subjected to the biasing force from the tension coil spring 281, is pivoted counter to the direction of the arrow G. The pivotal movement of the second lever 280 causes the arm 274 to pivot counter to the direction of the arrow J, so that the notched portion 274A presses the stop ring 273A, causing the pressing plate 266 to move counter to the direction of the arrow K so as to separate from the electrophotographic film 28.

Thereafter, the motor 298 is activated to move the film 28 through a distance corresponding to one frame. Thus, the frame which has been exposed is moved and positioned in front of the developing chamber 224. The amount of movement of the film 28 is controlled by sensing blip marks 34. When the movement of the film 28 is stopped, the solenoid 284 is energized to activate the pressing plate 266 to press the film 28 against the processing head 176 in a manner similar to the above. At the same time, the suction squeezing pump 244 shown in FIG. 16 is activated to generate a negative pressure in the recesses 242.

At the same time, the solenoid valve 230 is opened, and the developer which has been pumped up into the developer tank 232 from the developer bottle 238 by the action of the pump 236 is allowed to flow into the developing chamber 224 from the developer inlet 236. The developer having flowed down through the developing chamber 224 is returned to the developer bottle 238 from the developer outlet 228, and while doing so, the toner particles which are charged negative adhere to portions of the film 28 which are charged positive, thereby developing the electrostatic latent image. During the developing operation, the presence of the developing electrode 222 prevents occurrence of any edge effect.

The developer leaking out to the right and left sides of the projecting frame 220 of the developing chamber 224 is sucked in by the action of the suction squeezing pump 244 from the recesses 242. When the solenoid valve 230 is closed, the supply of developer is stopped and at the same time, the pressure squeezing pump 240 is activated to supply pressurized air to the developing chamber 224 from the developer inlet 226, whereby surplus developer attached to, for example, the non-charged surface of the film 28 is blown off so as to be swished off.

The supply of the pressurized air by the pressure squeezing pump 240 is controlled in such a manner that a relatively weak blast is applied while a relatively large amount of developer remains in the developing chamber 224 in order to prevent deterioration of the quality of the image which would otherwise be caused by an operation in which the developer is blown off at high speed. When a predetermined period of time has elasped after the application of the blast has been started, a relatively strong blast is applied to increase the squeezing efficiency.

When the operation of the pressure squeezing pump 240 is stopped, the solenoid 284 is de-energized, so that the pressing plate 266 is separated from the electrophotographic film 28. Thereafter, the motor 298 is activated to move the film 28 through a distance corresponding to one frame, and the developed frame is consequently positioned in front of the drying chamber 252. When the movement of the film 28 is stopped, the solenoid 284 is energized to cause the pressing plate 266 to press the film 28 against the processing head 176. At the same time, warm air is blown out from the warm air outlet 254, and the developer remaining on the film 28 is thereby dried.

When the application of warm air is completed, the pressing plate 266 is separated from the film 28 in a manner similar to the above. Thereafter, the film 28 is moved by an amount corresponding to one frame, and the frame concerned is thereby positioned in front of the fixing chamber 258. After the film 28 has been pressed against the processing head 176 by means of the pressing plate 266 in the same way as the above, the xenon lamp 260 is turned on, so that the toner particles are fused and fixed to the surface of the film 28 by the energy radiated from the lamp 260. Thereafter, the pressing plate 266 is separated from the film 28 in the same manner as the above.

Although each process has been described about only one frame of the electrophotographic film 28 by way of example, it is also possible to continuously effect recording on consecutive frames. In this case, these frames are simultaneously subjected to different kinds of processing, respectively.

The following is a description of the operation of projecting and copying an image recorded on the electrophotgraphic film by means of the optical systems shown in FIGS. 10 and 11.

In this case, a frame on the film 28 which is to be projected is positioned in front of the charging exposure chamber 214 of the processing head 176. In the system according to the presently preferred embodiment, the reader mode has been automatically selected when no button on the control keyboard 438 is actuated. In the reader mode, the third mirror 70 stands by in the position shown by the chain line in FIG. 13 in which the mirror 136 is in contact with the upper limit switch 160.

When the start button on the control keyboard 438 is pressed, the shutter 180 is opened, and the halogen lamp 184 in the projecting light source section 78 is turned on. In addition, the cooling fan 200 is activated. The light from the halogen lamp 184, together with the light reflected by the reflecting plates 186, is condensed by the condenser lens 188, reflected by the lower projecting mirror 190 so as to travel upward, condensed again by the condenser lens 196 and then reflected by the upper projecting mirror 198 so as to reach the rear surface of the electrophotographic film 28.

It should be noted that the lower projection mirror 190 is defined by a cold mirror which transmits heat rays, and therefore the light reaching the film 28 has a relatively low temperature.

The light having reached the film 28 is transmitted through the same, and the image recorded on the film 28 is formed on the first mirror 74 by the main lens 76.

The optical image formed on the first mirror 74 is reflected therefrom so as to reach the second mirror 72, and the image is further reflected by the mirror 72, transmitted through the screen 80 and projected thereon.

In the reader mode, it is possible to continuously view projected images of the film 28 within a short period of time by continuously advancing the frames of the film 28 through the operation of the buttons on the control keyboard 438. In this case, every time each frame of the frame 28 is caused to advance, the shutter 180 is closed, so that the occurrence of flickering resulting from the phenomenon of afterimage can be prevented. Also, at this time, the movable 61 rests on the uppermost portions or the lowermost portions of the guide rails 71 and 73.

The operation of copying an image recorded on an electrophotographic film by the optical system shown in FIG. 11 will be explained below.

In this case, when the copy button on the control keyboard 438 is pressed while an image is being projected on the screen 80, the driving gear in the copying machine 12 is activated, the movable mirror 61 is caused to move from the uppermost portions of the guide rails 71 and 73 to the lowermost portions of the same (or from lowermost to uppermost) by means of the previously-described mechanism and at the same time a movable member 85 formed with a slit is also caused to move in synchronism with the speed of travel of the movable mirror 61, the exposing drum 84 being further rotated. In addition, as shown in FIG. 16, the conversion lens 82 for slightly reducing the size of the image on the screen 80 is moved to a position between the main lens 76 and the first mirror 74. Moreover, at the same time, the feed rollers 406 and the associated members of the copying machine shown in FIG. 25 are activated by the driving force applied through the driving gear.

Simultaneously, since the energization of the charging device 398 is started, the charging device 398 produces corona discharge through the corona wire 408. The copying paper 86 in the shape of a roll is unwound by the action of the feed rollers 406 and transported to the exposing drum 84. In the course of this transportion, the copying paper 86 is electrically charged directly below the charging device 398. After the feed roller 406 has fed the copying paper 86 by a predetermined length, a clutch (not shown) is disengaged, so that the rotation of the feed rollers 406 is stopped. Immediately after that, the leading end portion of the paper 86 is cut in a sheet-like form by means of a cutter 396.

Then, the sheet-like copying paper 86 which has been electrically charged all over the surface thereof is wound around the exposing drum 84 by a winding device (not shown). When the leading end of the copying paper 86 arrives at a predetermined position of the exposing drum 84, this arrival is detected by a limit switch (not shown) disposed on the exposing drum 84, and the drive of the driving gear in the copying machine 12 is stopped. Thus, when the motion of the driving device has been stopped, the movable mirror 61 is caused to travel along the guide rails 71 and 73.

At the same time that the copying paper 86 is stopped on the exposing drum 84, the shutter 180 is opened for a predetermined period of time by the action of the automatic exposure controller (not shown), and an image recorded on the electrophotographic film 28 is formed on the first mirror 74 by the main lens 76 and the conversion lens 82. The size of the optical image formed on the first mirror 74 is made slightly smaller than that as in the case of the reader mode by the action of the conversion lens 82. The optical image is reflected by the first mirror 74 so as to reach the second mirror 72, and the optical image reflected by the mirror 72 is further incident on the movable mirror 61. When reflected by the mirror 61, the optical image is formed in a slit-like shape on the copying paper 86 laid over the exposing drum 84. An electrostatic latent image is formed on the thus-exposed copying paper 86. In this case, since the exposing drum 84 is caused to rotate in synchronism with the travel of the movable mirror 61, the electrostatic latent image is formed all over the exposed surface of the copying paper 86.

When the shutter 180 is closed, the driving gear of the copying machine 12 is again activated to rotate the driving shaft 410 of the exposing drum 84, so that the exposed copying paper 86 is transported to the developing device 402. In the developing device 402, the paper 86 is advanced into the gap between the toner roller 424 and the feed roller 426 by the action of the feed rollers 420, and the toner attached to the peripheral surface of the toner roller 424 adheres to the exposed surface of the paper 86 to develop the electrostatic latent image.

The developed copying paper 86 is further advanced to the fixing device 404 where it is pressed by the pressure rollers 428 to fix the toner. The copying paper 86 passed through the fixing device 404 reaches the delivery passage 430 where it drops gravitationally, sliding on the slope 532, and being discharged into the paper stacker 434.

While the above provides a full and complete disclosure of the invention, various modifications, alternative constructions and equivalents may be employed without departing from the true spirit and scope of the invention. Therefore, the above description and illustrations should not be construed as limiting the scope of the invention, which is defined solely by the appended claims.

What is claimed is:

1. A projecting, recording and copying apparatus for use in an electrophotographic system, comprising:

an image-forming optical system for forming an image recorded on a film on a screen;

a movable mirror of a narrow width disposed between said screen and said image-forming optical system in such a manner as to be capable of traveling in the direction of its width and swiveling about its longitudinal axis so as to reflect a portion of the light rays transmitted through said image-forming optical system;

a drum disposed for free rotation about its axis and having a photosensitive material on the surface thereof;

a mirror moving device for moving said movable mirror in the direction of its width; and a mirror swiveling device for swiveling said movable mirror about its longitudinal axis, wherein the widthwise travel and the longitudinal swivel of said movable mirror enables focusing on said drum the light rays reflected from said movable mirror and at the same time focusing on said screen the light rays passing by said movable mirror, whereby both projection of an image onto said screen and recording of the same on said photosensitive material are performed at the same time.

2. A projecting, recording and copying apparatus for use in an electrophotographic system according to claim 1, wherein said mirror moving device is arranged to cause movement of said movable mirror in such a manner that a distance from said image-forming optical system through said movable mirror to said screen equals an optical path length from said image-forming optical system through said movable mirror to said drum, said mirror swiveling device being arranged to swivel said movable mirror in such a manner that the light rays reflected from said movable mirror is focused on the surface of said drum in the form of a strip parallel to the longitudinal axis of said drum.

3. A projecting, recording and copying apparatus for use in an electrophotographic system according to claim 1, wherein said mirror moving device causes said movable mirror to travel at a speed synchronized with the circumferential speed of said drum.

4. A projecting, recording and copying apparatus for use in an electrophotographic system, comprising:

an image-forming optical system for forming an image recorded on a film on a screen;

a movable mirror of a narrow width disposed between said screen and said image-forming optical system in such a manner as to be capable of traveling in the direction of its width and swiveling about its longitudinal axis so as to reflect a portion of the light rays transmitted through said image-forming optical system;

a drum disposed for free rotation about its axis and having a photosensitive material on the surface thereof;

a mirror moving device for moving said movable mirror so that, if l represents the length of a perpendicular drawn from a principal point of said image-forming optical system to said screen, $\theta$ representing the angle formed by said perpendicular and a straight line connecting said principal point and the center of said movable mirror, $l\sec\theta$ may represent the sum of an optical path length as between said principal point and the center of said movable mirror and an optical path length as between the center of said movable mirror and the center of said surface of said drum; and a mirror swiveling device for swiveling said mirror in such a manner that a normal passing the center of said movable mirror normally passes the inner center of a triangle the vertexes of which are respectively constituted by the center of said movable mirror, the center of the surface of said drum and said principal point.

5. A projecting, recording and copying apparatus for use in an electrophotographic system according to claim 4 wherein, if R represents the radius of said drum, W representing the rotational speed of said drum and t representing the time, said mirror moving device causes movement of said movable mirror in such a manner as to fulfill the requirements represented by $l\tan\theta = R \cdot W \cdot t$.

6. A projecting, recording and copying apparatus for use in an electrophotographic system according to claim 4 further comprising a fixed mirror fixedly disposed between said movable mirror and said drum for reflecting the light rays reflected from said movable mirror and thereby forming an image on the surface of said drum.

7. A projecting, recording and copying apparatus for use in an electrophotgraphic system according to claim 4, further comprising a member including a slit which extends along the longitudinal axis of said drum, said member being disposed on the side of said drum upon which light rays are made incident.

8. A projecting, recording and copying apparatus for use in an electrophotographic system, comprising:

an image-forming optical system for forming an image recorded on a film on a screen;

a movable mirror of a narrow width disposed between said screen and said image-forming optical system in such a manner as to be capable of traveling in the direction of its width and swiveling about its longitudinal axis so as to reflect a portion of the light rays transmitted through said image-forming optical system;

a drum disposed for free rotation about its axis and having a photosensitive material on the surface thereof;

guide rail means each having a curve along which said movable mirror is made to travel so that, if l represents the length of a perpendicular drawn from a principal point of said image-forming optical system to said screen, $\theta$ representing the angle formed by said perpendicular and a straight line connecting said principal point and the center of said movable mirror, $l\sec\theta$ may represent the sum of an optical path length as between said principal point and the center of said movable mirror and an optical path length as between the center of said movable mirror and the center of the surface of said drum, and at the same time along which said movable mirror is made to swivel about its axis so that a normal passing the center of said movable mirror may normally pass the inner center of a triangle the vertexes of which are respectively constituted by the center of said movable mirror, the center of the surface of said drum and said principal point; and slide means for allowing said movable mirror to slide along said guide rail means.

9. A projecting, recording and copying apparatus for use in an electrophotographic system according to claim 8, wherein said guide rail means comprise:

a first guide rail provided with a curve for allowing said movable mirror to swivel about its axis in such a manner that said normal passing the center of said movable mirror normally passes the inner center of said triangle the vertexes of which are respectively constituted by the center of said movable mirror, the center of the surface of said drum and said principal point; and a second guide rail provided with a curve for allowing said movable mirror to travel therealong in such a manner that, if l represents the length of said perpendicular drawn from said principal point of said image-forming optical system to said screen, $\theta$ representing said angle formed by said perpendicular and said straight line connecting said principal point and the center of said movable mirror, $l\sec\theta$ may represent the sum of said optical path length as between said principal point and the center of said movable mirror and said optical path length as between the center of said movable mirror and the center of said surface of said drum.

10. A projecting, recording and copying apparatus for use in an electrophotographic system according to claim 9, wherein said movable mirror includes rod means and slide means, said rod means extending longitudinally from said movable mirror and having an axis corresponding to the center of said movable mirror, said rod means being allowed to slide along said first guide rail with said slide means being allowed to slide along said second guide rail.

11. A projecting, recording and copying apparatus for use in an electrophotographic system according to claim 8, wherein said movable mirror is urged with respect to said guide rail means by urging means.

* * * * *